US010099109B2

(12) United States Patent
Pittard et al.

(10) Patent No.: US 10,099,109 B2
(45) Date of Patent: Oct. 16, 2018

(54) SKI LOCKING DEVICE

(71) Applicant: Loqski International Limited, London (GB)

(72) Inventors: James Pittard, Somerset (GB); Jaquie Pittard, Somerset (GB); Sarah Debard, Somerset (GB); Julian Swan, London (GB)

(73) Assignee: Loqski International Limited, London (GB)

( * ) Notice: Subject to any disclaimer, the term of this patent is extended or adjusted under 35 U.S.C. 154(b) by 0 days.

(21) Appl. No.: 14/655,102

(22) PCT Filed: Dec. 20, 2013

(86) PCT No.: PCT/EP2013/077710
§ 371 (c)(1),
(2) Date: Jun. 24, 2015

(87) PCT Pub. No.: WO2014/102193
PCT Pub. Date: Jul. 3, 2014

(65) Prior Publication Data

US 2016/0213998 A1 Jul. 28, 2016

(30) Foreign Application Priority Data

Dec. 24, 2012 (GB) ..... 1223349.0

(51) Int. Cl.
*A63C 11/00* (2006.01)
*E05B 39/00* (2006.01)
(Continued)

(52) U.S. Cl.
CPC ..... *A63C 11/006* (2013.01); *E05B 39/005* (2013.01); *E05B 45/06* (2013.01);
(Continued)

(58) Field of Classification Search
CPC .. Y10T 70/5009; Y10T 70/409; Y10T 70/411; Y10T 70/435; Y10T 70/483;
(Continued)

(56) References Cited

U.S. PATENT DOCUMENTS 3,465,325 A * 9/1969 Goldfarb ..... G08B 13/26 340/521
3,518,853 A * 7/1970 Bolte ..... A63C 11/005 280/28.14
(Continued)

FOREIGN PATENT DOCUMENTS

AU 1693470 A 1/1972
DE 19 33 381 A1 1/1971
(Continued)

*Primary Examiner* — Suzanne L Barrett
(74) *Attorney, Agent, or Firm* — Optimus Patents US, LLC

(57) ABSTRACT

A ski locking device and method for securing a pair of snow skis equipped with snow brakes are provided. The ski locking device comprises a housing (1320) having a rear portion (240), and a lockable closure member (1370) connected to the housing (1320). The housing (1320) and the lockable closure member (1370) are configured such that, when the ski locking device is in a closed position locking a pair of skis, with a slide surface of the first ski (3010) facing a slide surface of the second ski (3020), the rear portion (240) of the housing (220) faces a first edge (3012) of the first ski (3010) and a second edge (3022) of the second ski (3020). The lockable closure member (1370) encloses the snow brakes (3040; 3050) at a crossing point (3060) of the snow brakes.

18 Claims, 24 Drawing Sheets

(51) Int. Cl.

| | |
|---|---|
| ***E05B 45/06*** | (2006.01) |
| ***E05B 63/00*** | (2006.01) |
| ***E05B 63/12*** | (2006.01) |
| ***E05B 71/00*** | (2006.01) |

(52) U.S. Cl.
CPC ..... *E05B 63/0034* (2013.01); *E05B 63/12* (2013.01); *E05B 71/00* (2013.01); *E05B 2045/0695* (2013.01)

(58) Field of Classification Search
CPC ..... Y10T 70/40; Y10T 70/50; Y10T 24/316; Y10T 24/3428; Y10T 24/3439; Y10T 24/4453; Y10T 70/5867; A63C 11/005; A63C 11/006; E05B 71/00; E05B 2045/0695; E05B 63/12; E05B 63/0034; E05B 45/06; E05B 39/005
USPC ..... 70/14–16, 18, 19, 57, 58
See application file for complete search history.

(56) References Cited

U.S. PATENT DOCUMENTS 3,590,608 A * 7/1971 Smyth ..... A63C 11/006 280/814
3,874,202 A * 4/1975 Effenheim ..... A63C 11/007 211/70.5
3,905,214 A * 9/1975 Bell ..... A63C 11/006 211/70.5
3,962,893 A * 6/1976 Anderson ..... A63C 11/006 280/814
3,999,409 A * 12/1976 Bell ..... A63C 11/006 280/814
4,057,983 A * 11/1977 Morgan ..... A63C 11/006 24/327
4,059,209 A * 11/1977 Grisel ..... A63C 11/009 211/70.5
4,102,163 A * 7/1978 Bosch ..... A63C 11/005 70/58
4,144,728 A * 3/1979 Boynton ..... A63C 11/006 280/814
4,146,242 A * 3/1979 Bose ..... A63C 11/02 280/814
4,231,586 A * 11/1980 Krause ..... A63C 11/005 224/917
4,398,403 A * 8/1983 Menick ..... A63C 11/006 70/18
4,419,872 A * 12/1983 Plifka ..... A63C 11/006 206/315.1
4,598,561 A * 7/1986 Girard ..... A63C 11/006 70/19
5,802,887 A * 9/1998 Beland ..... A63C 11/006 180/190
6,089,054 A * 7/2000 Stukas ..... A63C 11/005 70/18
6,164,097 A * 12/2000 McBryde ..... E05B 67/383 70/18
6,273,272 B1 * 8/2001 Hake ..... A63C 11/028 211/4
8,225,458 B1 * 7/2012 Hoffberg ..... E05F 3/102 16/49
2005/0029759 A1 2/2005 Resch et al.
2005/0262901 A1 * 12/2005 Parsons ..... E05B 75/00 70/16
2007/0056332 A1 3/2007 Parsons et al.
2007/0090921 A1 * 4/2007 Fisher ..... G07C 9/00103 340/5.73
2007/0096870 A1 * 5/2007 Fisher ..... E05B 19/0005 340/5.53
2008/0072633 A1 * 3/2008 Samuel ..... E05B 67/003 70/58
2011/0251876 A1 * 10/2011 Fisher ..... G06Q 10/08 705/7.32
2014/0240255 A1 * 8/2014 Kim ..... G06F 3/0488 345/173
2015/0245666 A1 * 9/2015 Memari ..... A24F 15/12 131/329

FOREIGN PATENT DOCUMENTS

| | | | |
|---|---|---|---|
| DE | 1933381 | A1 | 1/1971 |
| DE | 2827182 | A1 | 1/1980 |
| DE | 20 2008 007377 | U1 | 8/2008 |
| DE | 2008007377 | U1 | 8/2008 |
| EP | 1176274 | A2 | 1/2002 |
| WO | WO02061223 | A2 | 8/2002 |
| WO | 2011/101220 | A1 | 8/2011 |
| WO | 2011101220 | A1 | 8/2011 |

* cited by examiner

100

SKI LOCKING DEVICE

FIELD OF THE INVENTION

The present invention relates to a portable locking device. In particular, the portable locking device may be configured for securing snow skis, and may also secure snow poles

BACKGROUND

Skis are occasionally lost to theft or unintentional mix up, when left unattended in ski resorts. This may happen, for example, outside mountain restaurants and cafés, where many hundreds of pairs of skis may be deposited from time to time. It is also possible in hotel ski/boot rooms, and outside village bars and restaurants.

Portable security devices have therefore been developed for the ski market. These include, for example, cable or chain combination locks. Some known locks enable one or more snowboards or sets of skis to be secured together and/or to other permanent fixings such as a ski rack or the like. Such locks tend to be marketed as ski locks, but many are in fact generic combination cable or chain locks, which may be used for securing other portable high value items such as bicycles and luggage.

Dedicated ski locks have been developed, including for example locks of the type disclosed in U.S. Pat. No. 4,111,015. In U.S. Pat. No. 4,111,015, the skis are locked in a crossed position so as to discourage theft when left unattended for short periods of time. The ski lock disclosed in U.S. Pat. No. 4,111,015 comprises male and female brackets, which are secured to respective skis for mutual engagement and disengagement. A combination lock is provided on one of the brackets. The male and female security brackets are attached to the upper surface of the skis adjacent the bindings, so that the skis may be locked together in an X configuration. U.S. Pat. No. 4,057,983 provides a hinged clamp, for locking skis together. U.S. Pat. No. 4,146,242 also provides a two-part lock for a pair of skis, and the two parts may be connected by a hinge.

There are various disadvantages associated with this type of ski lock, particularly since the intention is just to discourage theft when the skis are left unattended in a ski resort. Many ski locks do not provide security for the ski poles. Nor can they be used to provide additional security, by enabling the skis to be secured to fixed structures.

SUMMARY OF THE INVENTION

According to a first aspect of the invention there is provided a ski locking device in accordance with appended claims. According to a second aspect of the invention there is provided a method of locking a pair of snow skis and/or ski poles in accordance with the appended claims.

In the ski locking device, different elements of the device are provided for securing both the ski poles and the skis. The locking device has the advantage of being portable. When the ski locking device is in the closed position locking the pair of skis, a space enclosed by a lockable closure member may be of an adjustable size.

A main body of the ski locking device comprises a housing. The lockable closure member may comprise a first ratchet cuff with indentations, the first ratchet cuff being configured to be pivotable about a pivot point. The first ratchet cuff may engage with a first ratchet mechanism. When the lockable closure member is in the closed position, the first ratchet mechanism is configured to engage with an indentation on the first ratchet cuff, to lock the lockable closure member. The first ratchet mechanism may comprise a first tooth, comprised of a sprung peg, which is located at the lower part of the housing. When the ski locking device is locked, the first tooth may be operable to lock into position in contact with one of the indentations on the first ratchet cuff, thereby preventing further movement of the first ratchet cuff.

The ski locking device may further comprise a first arm comprising a second ratchet cuff, the first arm being moveable, and being configured to rotate from a first storage position to a first deployed position. The ski locking device may further comprise a second arm comprising a third ratchet cuff, the second arm being moveable, and being configured to rotate from a second storage position to a second deployed position. When the first arm is in the first storage position, the first arm lies adjacent to a first side of the lockable closure member. When the second arm is in the second storage position, the second arm lies adjacent to a second side of the lockable closure member.

When the first arm is in the first deployed position, the second ratchet cuff is operable to lock around a first ski pole. When the second arm is in the second deployed position, the third ratchet cuff is operable to lock around a second ski pole. The second ratchet cuff further comprises second indentations serving as latch features. The second indentations engage with a tooth mounted on a first side of the housing, the first arm being on the first side of the housing when in the first deployed position. The third ratchet cuff further comprises third indentations that also serve as latch features. The third indentations engage with a tooth mounted on a second side of the housing, the second arm being on the second side of the housing when in the second deployed position.

The housing and the lockable closure member may be configured such that, when the ski locking device is in the closed position locking the pair of skis, with the slide surface of the first ski facing the slide surface of the second ski, the rear portion of the housing abuts the first edge of the first ski and the second edge of the second ski. The rear portion of the housing has a central protruding portion. When the separation between the edges of the skis and the crossing point of the snow brakes is relatively small, the central protruding portion may lie between the slide surface of the first ski and the slide surface of the second ski, when the ski locking device is in a closed position. The central protruding portion may help guide the ski locking device as a user moves it along the edges of the skis, towards the point where the first ratchet cuff passes behind the crossing point of the ski brakes.

A cylinder cam lock within the housing is operable to lock the locking device, by locking into position the multiple teeth protruding from the outer surface of the housing. One tooth may then engage with and retain the first ratchet cuff, another tooth may engage with and retain the second ratchet cuff, and another tooth may engage with and retain the third ratchet cuff

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Various embodiments of the invention will now be more particularly described, by way of example only, with reference to the accompanying drawings.

FIG. 1 is a perspective view of a ski locking device according to an embodiment of the invention.

FIG. 2 is a lateral perspective view of the ski locking device, with the locking device in the stowed configuration.

FIG. 3 is a front and side perspective view of the ski locking device, in close-up, with the tether removed.

FIG. 4 is a side elevation view of the ski locking device, with the tether attached.

FIG. 5 is a perspective view of an arm of the ski locking device, which is shown separately from the remainder of the ski locking device.

FIG. 6 shows various perspective and elevation views of a ratchet cuff of the ski locking device, which is shown separately from the remainder of the ski locking device.

FIG. 7 shows various perspective and elevation views of the housing, which is shown separately from the remainder of the ski locking device.

FIG. 8 shows various perspective and elevation views of a cam lock, which is shown separately from the remainder of the ski locking device.

FIG. 9 is a perspective view of the ski locking device in an inverted orientation, with the second and third ratchet cuffs open.

FIG. 10 is a perspective view of the ski locking device, from the front.

FIG. 11 is another perspective view of the ski locking device, from the front.

FIG. 12 is another perspective view of the ski locking device, from the front.

FIG. 13 provides a perspective view of the ski locking device when placed against a pair of skis.

FIG. 14 provides another perspective view of the ski locking device when placed against a pair of skis.

FIG. 15 provides a perspective view of the ski locking device locked around the crossing point of the snow-brakes.

FIG. 16 provides a perspective view of the ski locking device locked around the crossing point of the snow-brakes.

FIG. 17 provides a perspective view from below of the ski locking device in the configuration of FIG. 16.

FIG. 18 provides another perspective view of the ski locking device locked around the crossing point of the snow-brakes.

FIG. 19 shows the action of locking the ski locking device.

FIG. 20 illustrates the locked state of the moving parts of the ski locking device.

FIG. 21 illustrates a plan view of the ski locking device.

Figure 1:
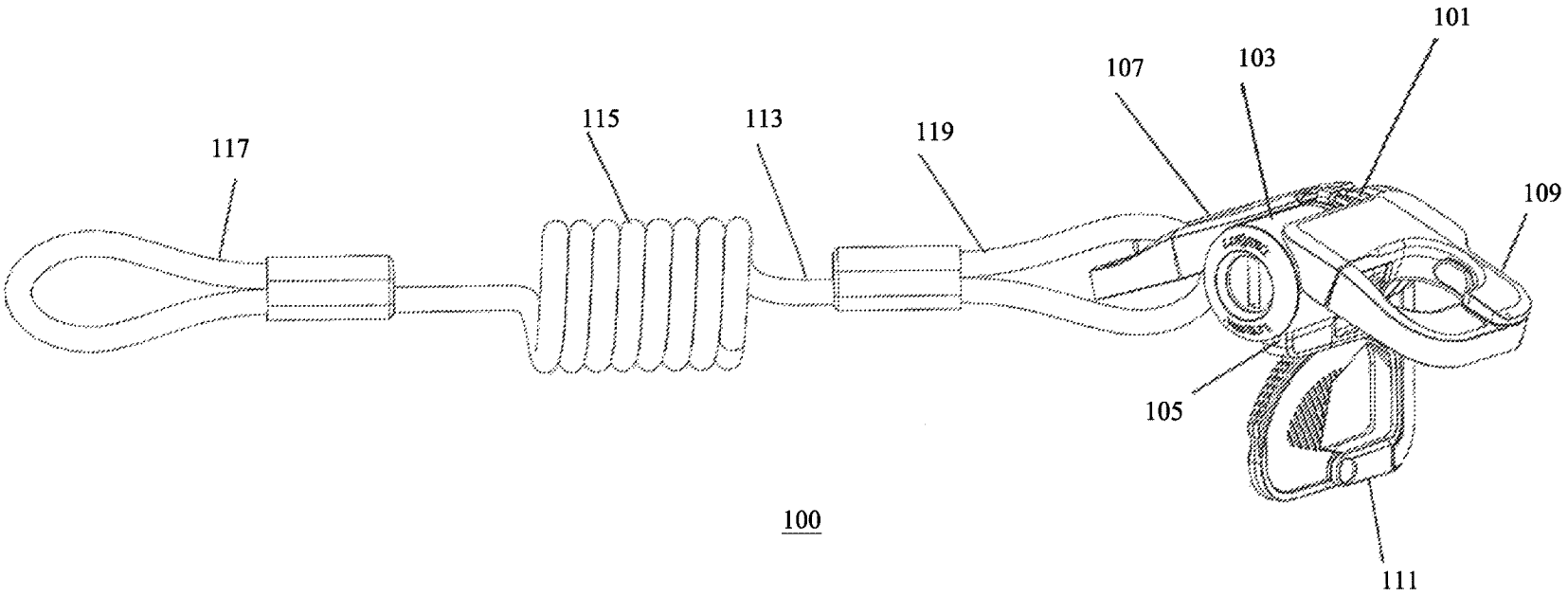
FIGS. 1-9 are primarily focussed on the structure of the ski locking device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a ski locking device. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

A ski locking device for securing a pair of snow skis comprises a housing having a rear portion. A lockable closure member is connected to the housing. The housing and the lockable closure member are configured such that, when the ski locking device is in a closed position locking a pair of skis, with a slide surface of the first ski facing a slide surface of the second ski: the rear portion of the housing faces a first edge of the first ski and a second edge of the second ski; and the lockable closure member encloses the snow brakes at a crossing point of the snow brakes.

The figures show details of the ski locking device of the invention. The locking device may, advantageously, be hand portable. When skiing, the locking device may therefore be stowed in a pocket or small rucksack.

The invention provides a locking device that serves as a lock for securing an abutted pair of skis. The locking device may also secure two ski poles. A secondary tether allows the locking device to be releasably attached to a permanent structure. The locking device can therefore serve as an anti-theft device for both skis and ski poles. A mechanical lock and key may be operable down to two-digit sub-zero temperatures.

The locking device utilises the point where the snow brakes of a pair of skis overlap, when two skis are abutted together. By locking a central locking member around the snow brake crossing point, which constitutes a 'central point' of the pair of skis when placed together, the locking device prevents the skis from being pulled apart. The central locking member locks around the snow brake crossing-point by means of a ratchet mechanism similar to a hand-cuff. The space enclosed by the cuff, in the closed position, is adjustable in size to accommodate different snow brake arrangements.

In addition to the central locking member, two further arms are used to lock the ski poles. These arms have ratchet cuffs. When in an open position, a pole can be inserted into each. The poles can then be locked individually, aligned with the skis. When not in use, the pole locking arms can each be rotated down to a storage position. The pole locking arms then lie either side of the central locking member, to be flush with the central cuff. The space enclosed by each of the cuffs can be adjusted in size by a ratchet mechanism. All three are locked in place with a single locking point.

The lock may also be supplied with a flexible, curly, coiled tether. This is used in combination with the interlocking cuffs to secure the skis and poles to a more secure anchor, such as a ski rack. The tether may be a separate tether, comprising a closed loop at either end. In operation, the ski locking device can be fastened to another object by passing the tether around the object, and enclosing each closed loop of the tether in one of the second ratchet cuff and the third ratchet cuff. The loops of the tether may be enclosed in the first ratchet cuff of the lockable closure member, but this may be less advantageous than enclosing each closed loop in one of the second ratchet cuff and the third ratchet cuff. The tether may also be used in a configuration similar to a lasoo. In this arrangement, one loop of the tether is pushed through the other loop, to create a noose. Then only the end of the loop that was pushed through the other loop needs to be enclosed in one of the second ratchet cuff and the third ratchet cuff.

In an alternative arrangement, one end of the tether may be attached to the main body of the lock. The opposite end of the tether then has a loop which can be attached to either of the cuffs, once looped around the secure anchor. The tether can still be replaced if worn, or if the consumer wishes to have a customised look. This is achieved through an interlocking feature on the body of the main lock, whereby the tether can only be removed when the lock is in the open position.

The ski lock may use a modified 'cylinder cam' type lock. A flat plate pawl of a known cylinder cam lock may be replaced with a bespoke cam. The cuff ratchets engage with sprung pegs, which protrude from the housing of the ski locking device. When the key is in the open (unlocked) position, the cam is moved to a position which allows the pegs to depress as the cuffs are rotated across the tops of them. However, when the key is locked, the cam restricts the pegs' movement, and therefore locks the ratchet cuffs. The sprung pegs may also be termed 'teeth'. The cylinder cam lock within the housing is therefore operable to lock the locking device, by locking into position the multiple sprung pegs/teeth protruding from the outer surface of the housing, whereby a first tooth locks into position to prevent movement of the ratchet cuff of the lockable closure member, a second tooth locks into position to prevent movement of the second ratchet cuff, and a third tooth locks into position to prevent movement of the third ratchet cuff.

With the ski locking device, an advantageous mutual orientation of the clamp parts may be provided, when they are in the deployed position. The ski locking device can be used to lock a pair of skis with the snow brakes in their crossed, stored position. The device may be manipulated easily between the deployed condition, and the compact, stowed position.

Notably, the ski locking device offers a three point security system. A first ratcheted cuff secures interlocking snow brakes on abutted skis, and two further cuffs secure ski poles either side of the locking cylinder. A secondary tether allows the ski locking device to be secured to a permanent fixture, for example a ski rack, post or roof rack. The secondary tether may be a coiled, plastic coated galvanised cable, which can be removed entirely from the device, to facilitate separate storage.

The ski locking device may be applied to a pair of skis, in one of two different orientations. Firstly, the ski locking device may be placed in a closed position, locking a pair of skis, oriented with the lockable closure member below the housing. In this case, the second ratchet cuff is closable by movement in an anti-clockwise direction, when viewed from above, and the third ratchet cuff is closable by movement in a clockwise direction, when viewed from above. Alternatively, the ski locking device may be placed in a closed position, locking a pair of skis, oriented with the lockable closure member above the housing. In this case, the second ratchet cuff is closable by movement in a clockwise direction, when viewed from above. The third ratchet cuff is closable by movement in an anti-clockwise direction, when viewed from above. The orientation with the lockable closure member above the housing is referred to as an 'inverted' orientation in the description. However, either orientation may be used. The term 'inverted' orientation has been chosen for the orientation with the lockable closure member above the housing, which is shown in two of the drawings, because the majority of the drawings show the orientation with the lockable closure member below the housing.

Once secured on the snow brakes, with poles and tether latched in place, the ski locking device can be used to carry all the ski equipment. Alternatively or in addition, the ski locking device may facilitate transportation on a roof rack or in storage area of a vehicle.

The ski locking device may offer some or all of the following advantages:

(i) The device is portable, and in its stowed position readily stored in a ski jacket pocket.

(ii) Utilising a three-point security system, the ski locking device secures: a pair of skis in an abutted arrangement at the point that their snow brakes interlock; two ski poles; and provides the optional use of a secondary tether.

The ski locking device is deployable on a range of different snow skis and ski poles. It may be applied, potentially, on snowboards, cycles, luggage, or on any item of equipment/kit that would benefit from multiple locking points and a secondary tether.

The second ratchet cuff and the third ratchet cuff may be identical. In this case, when manufacturing the ski locking device, the second ratchet cuff is mounted to the housing in an inverted orientation relative to the third ratchet cuff. A raised lip may run around an outer curved edge of the second and third ratchet cuffs. The raised lip provides an edge for a user to pull against when opening the ratchet cuff.

A first flexible pole bumper element may lie in the inner edge of the second ratchet cuff. A second flexible pole bumper element may lie in the inner edge of the third ratchet cuff.

The ski locking device may further comprise an alarm function, operable to provide an alarm indication when the tether has been cut. The alarm function may be implemented as an app on a processor means within the ski locking device, the alarm function operable to generate and send a text message as the alarm indication that the tether has been cut. The ski locking device may further comprise a fingerprint recognition subsystem, the fingerprint recognition subsystem being operable to unlock the ski locking device.

The ski locking device may further comprise a light finder subsystem, the light finder subsystem illuminating a portion of the ski locking device in response to a signal from a user of the ski locking device. A light finder subsystem may be integrated into the tether, the light finder subsystem illuminating a portion of the tether in response to a signal from a user of the ski locking device. The signal may be one of a transmitted signal from a key fob device comprising a battery, the key fob device being activated by a user, or a voice signal from the user.

The ski locking device may further comprise a solar cell forming part of the ski locking device, the solar cell operable to provide energy to the ski locking device. The solar cell may form part of the tether.

The ski locking device may further comprise a temperature measurement function, whereby in operation a temperature indication may be provided to a user of the ski locking device. A temperature indication may be provided as operation of, or a change to a colour of, an illumination function of the ski locking device. The ski locking device may further comprise a GPS locator app, whereby in operation the GPS locator app transmits an indication of the location of the ski locking device, remotely, to a user.

Throughout the drawings, corresponding elements have been given similar reference numerals where possible.

FIG. 1 is a perspective view of a ski locking device 100 according to an embodiment of the invention. Ski locking device 100 includes a main body 101. The main body 101 comprises several parts, of which housing 103 is indicated on FIG. 1. A front portion 105 of housing 103 is visible on FIG. 1.

First arm 107 and second arm 109 extend from either side of housing 103. First arm 107 and second arm 109 are moveable with respect to housing 103, as will be illustrated and explained in subsequent figures. A first lockable closure member 111 extends from the lower surface of housing 103.

Locking device 100 also comprises a tether 113. Tether 113 does not form part of the main body 100 of the locking device. Tether 113 may be flexible. Tether 113 comprises a curled portion 115, which may be reversibly uncoiled by pulling. Tether 113 also comprises first loop 117 and second loop 119. When first loop 117 is pulled in a direction away from main body 101 with second loop 119 held by one of the ratchet cuffs, curled portion 115 may uncurl, allowing first loop 117 to reach a point far from main body 101. When the pull force on first loop 117 is removed, tether 113 may then return to the configuration shown in FIG. 1.

Figure 2:
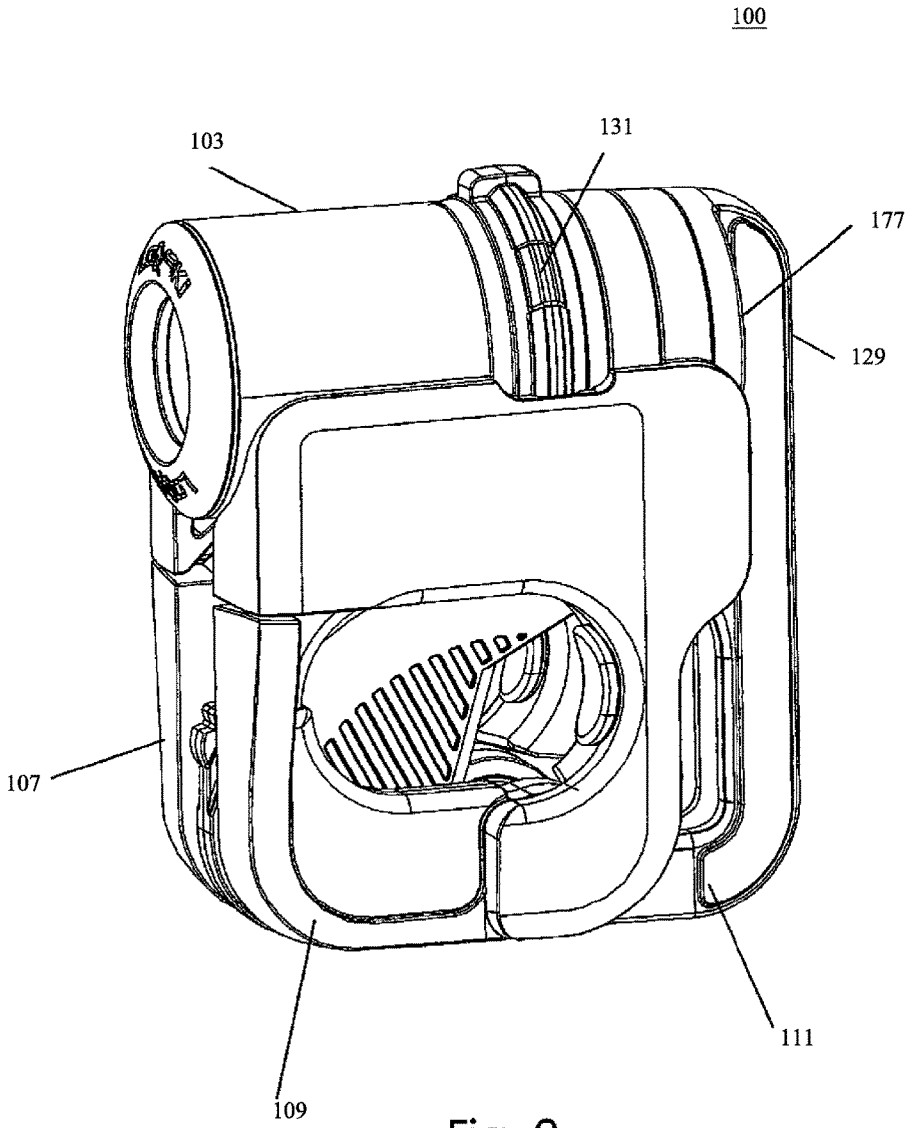

FIG. 2 is a lateral perspective view of the ski locking device 100. In FIG. 2, ski locking device 100 has been rotated relative to the view shown in FIG. 1. In addition, ski locking device 100 is shown in the stowed configuration. The stowed configuration of ski locking device 100 is the configuration when ski locking device 100 is not in use. The compact configuration of ski locking device 100 results in ski locking device 100 being easy to transport, as can be seen in FIG. 2.

Housing 103 of ski locking device 100 is shown in FIG. 2. First lockable closure member 111 is also shown. In FIG. 2, first lockable closure member 111 is almost entirely concealed by second arm 109.

First arm 107 is shown in a first storage position. In the first storage position, first arm 107 lies adjacent to a first side of lockable closure member 111. Second arm 109 is shown in a second storage position. In the second storage position, second arm 109 lies adjacent to a second side of lockable closure member 111. In the view shown in FIG. 2, second arm 109 is nearest to the viewer's location. Slightly further from the viewer's location is lockable closure member 111. Furthest from the viewer's location is first arm 107.

Housing 103 has a rear portion, which is generally indicated by reference numeral 125. Throughout the drawings, the end of the housing 103 that reference numeral 127 contacts in FIG. 2, will be referred to as the rear portion 127. The opposite end of housing 102 is the front portion 105, referred to in FIG. 1.

Rear portion 127 of housing 103 has a protruding portion 129. Protruding portion 129 is located towards the mid-point of rear portion 127. Protruding portion 129 may extend down the rear portion 127 from the top of the housing. Protruding portion 127 may join with or form the rear part of lockable closure member 111, i.e. extend all the way to the lowest point at the rear of the housing 103.

Also shown on FIG. 2 is third tooth 131. The purpose of third tooth 131 will be described subsequently, in the later figures that describe the operation of ski locking device 100. Third tooth 131 is spring loaded. Third tooth 131 may be depressed radially, in towards the centre line of housing 103, when ski locking device 100 is unlocked. When ski locking device 100 is locked, third tooth 131 is fixed, and can no longer be depressed.

Figure 3:
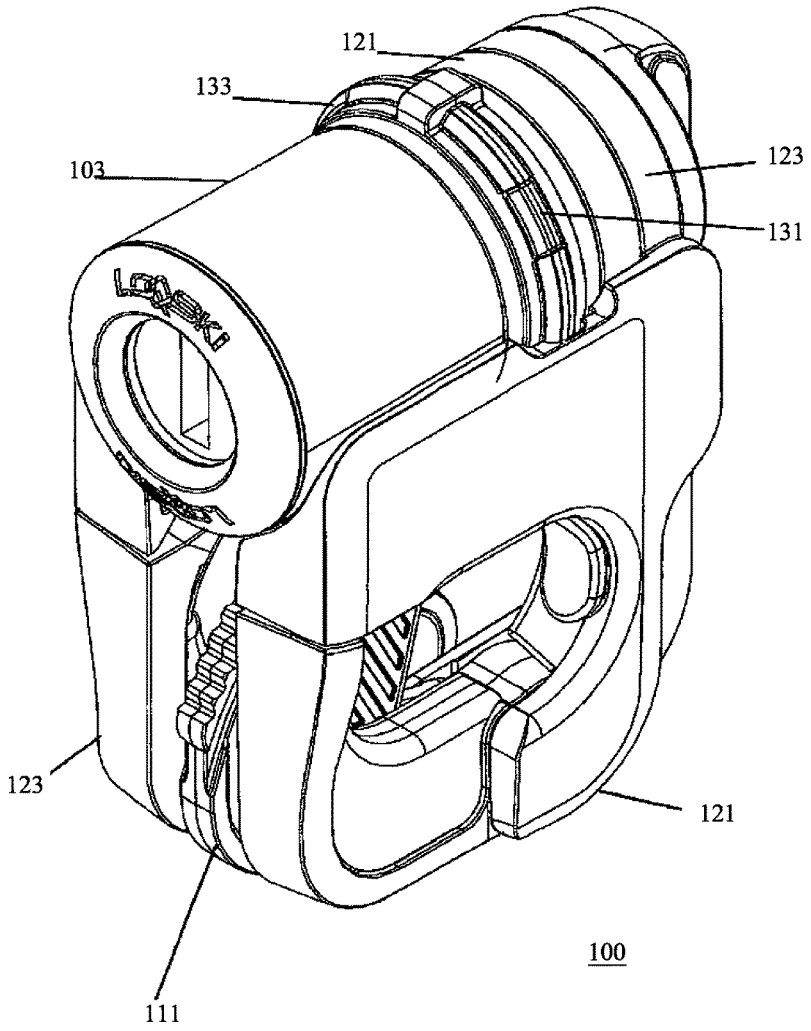

FIG. 3 is a front and side perspective view of ski locking device 100, in close-up. As in FIG. 2, ski locking device 100 is shown in the stowed configuration. Lockable closure member 111 is more clearly visible in FIG. 3. First arm 107 lies adjacent to a first side of lockable closure member 111. Second arm 109 lies adjacent a second side of lockable closure member 111.

The upper surface of part of a first mounting ring 121 is shown in FIG. 3. First mounting ring 121 is attached to first arm 107. First mounting ring 121 extends around the circumference of housing 103, and is rotatable around housing 103. Thus first arm 107 may move up from the first storage position shown in FIG. 3, for example to the orientation shown for first arm 107 in FIG. 1. First mounting ring 121 will rotate around housing 103, as this movement occurs.

The upper surface of part of a second mounting ring 123 is also shown in FIG. 3. Second mounting ring 123 is attached to second arm 109. Second mounting ring 123 extends around the circumference of housing 103, and is rotatable around housing 103. Thus second arm 109 may move up from the second storage position shown in FIG. 3, for example to the orientation shown for second arm 109 in FIG. 1. Second mounting ring 123 will rotate around housing 103, as this movement occurs.

Also visible on FIG. 3 are third tooth 131 and second tooth 133. Second tooth 133 is positioned on the same side of the housing as first arm 107, which is the opposite side of housing 103 to third tooth 131 in FIG. 2. Second tooth 133 is moveable, as explained in relation to third tooth 131.

Figure 4:
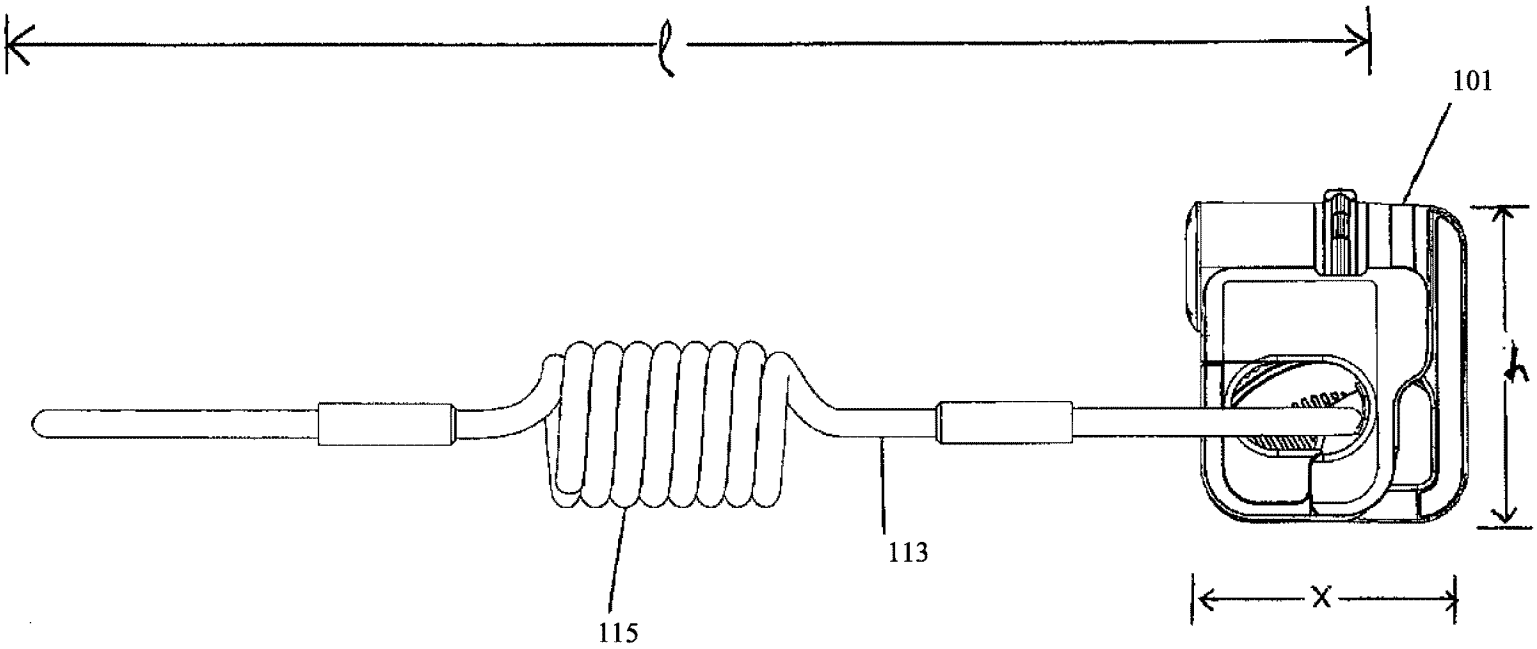

FIG. 4 is a side elevation view of ski locking device 100. FIG. 4 is designed to provide exemplary dimensions for ski locking device 100.

The following examples of dimensions for ski locking device 100 are non-limiting:

(i) Length x of main body 101 may be in the range 4 cm-15 cm. In a preferred embodiment, length x may be 6.5 cm;

(ii) Height h of main body 101 may be in the range 4 cm-15 cm. In a preferred embodiment, height h may be 6.5 cm;

(iii) Length 1 of tether 113, when not stretched, may be in the range 8 cm-50 cm. In a preferred embodiment, length 1 may be 15 cm.

When tether 113 is stretched, it may extend to a length in the range 40 cm-1.5 meters. In a preferred embodiment, tether 113 may extend to 90 cm. In an embodiment where tether 113 does not comprise a curled portion 115, its rest length may be in the range 40 cm-2 meters.

Figure 5:
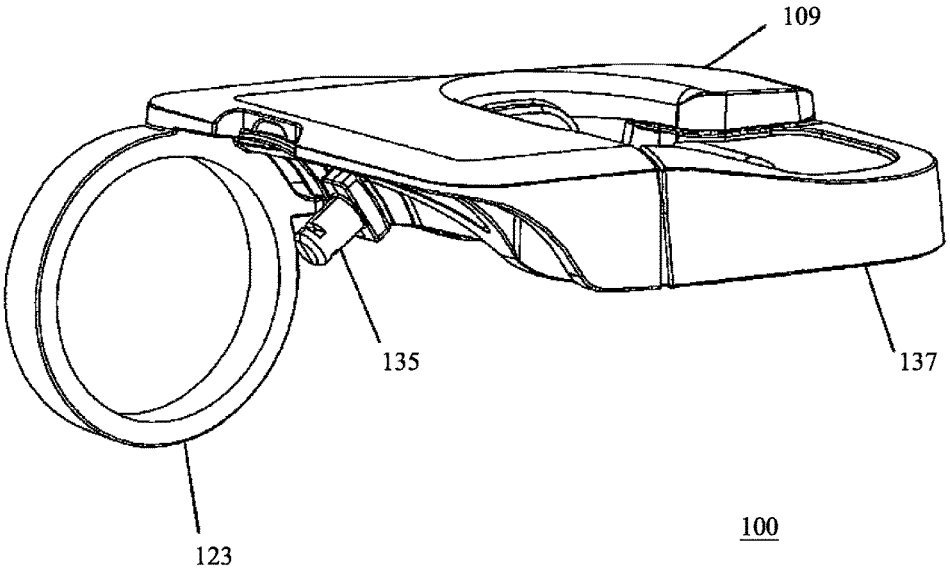

FIG. 5 is a perspective view of second arm 109. Second arm 109 is shown separately from housing 103. When the ski locking device is assembled, second arm 109 is mounted on housing 103, and would not be removed as part of normal operation of the ski locking device. Second mounting ring 123 is now clearly visible in its entirety.

Also visible on FIG. 5 is locking pin 135. A spring pushes locking pin 135 out from the centre of the ski locking device. Locking pin 135 lies under the third tooth 131, and controls whether the third tooth 131 is locked into position. Locking pin 135 co-operates with the indentations or 'latch features' on the ratchet cuff. These are the latch features shown in FIG. 6. When the ski locking device is in the unlocked state, locking pin 135 is free to move in towards the centre of the housing 103. In this unlocked condition, the indentations on the ratchet cuff that contact the top of the tooth are allowed to bump past the tooth, as a user pushes or pulls the ratchet arm. The indentations are the latching features on the ratchet. When the ski locking device is in the locked state, pin 135 is prevented from travelling into the body. Pin 135 therefore stays securely located in the latch features of the ratchet cuff, thereby preventing the cuff from being opened.

Part of second arm 109 comprises a second cuff 137. Only part of second cuff 137 is visible in FIG. 5. Parts of second cuff 137 that are not visible in FIG. 5 are concealed within second arm 109, to which second cuff 137 is moveably attached.

Although not shown in FIG. 5, first arm 107 in FIG. 3 is of comparable construction to second arm 109. First arm 107 and first mounting ring 121 are a mirror image of second arm 109 and second mounting ring 123. The main body of the ski locking device has a locking pin corresponding to locking pin 135 shown on FIG. 5 engaging second arm 109.

Figure 6:
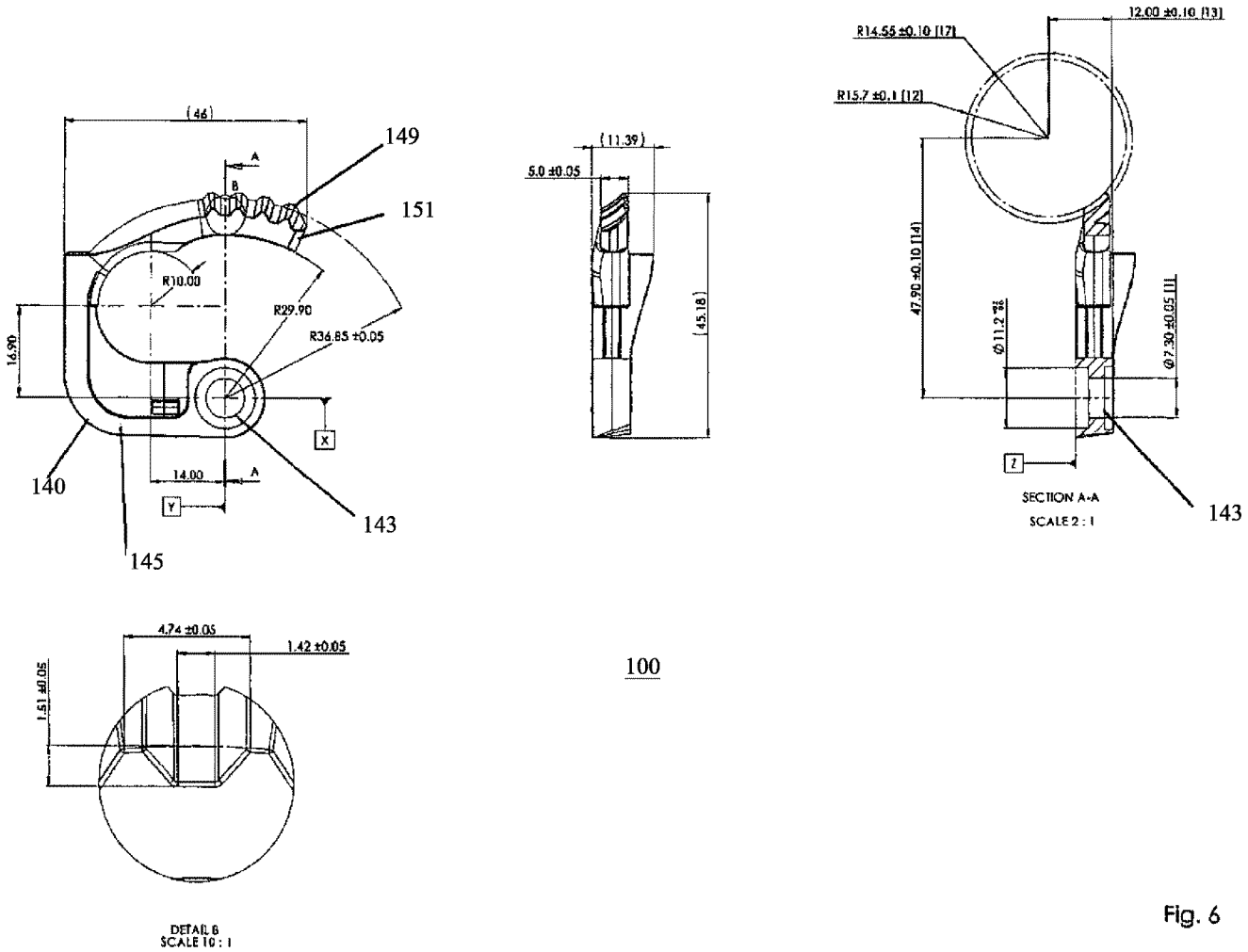

FIG. 6 shows various perspective and elevation views of a ratchet cuff 141. Each of first arm 107, second arm 109 and lockable closure member 139 may comprise a ratchet cuff of the general form shown in FIG. 6.

Reference 140 shows a sectional view through the cuff. Cuff 141 is shown separately. When the ski locking device is assembled, cuff 141 can pivot, but would not be removed entirely as part of normal operation of the ski locking device.

Pivot point 143 indicates a point on cuff 141 where it is connected either to the fixed portion of lockable closure member 139, or to the arm on which it is mounted. In use, cuff 141 pivots about point 143. Thickened portion 145 of cuff 141 corresponds to portion 147 of the cuff visible in FIG. 5. See also FIG. 9. Latch features 149 protrude above end portion 151, which extends from thickened portion 145.

FIG. 6 most closely describes the shapes of the second and third ratchet cuffs. The first ratchet cuff of lockable closure member 129 may, however, be slightly slimmer than portion 147 shown in FIG. 6. The first ratchet cuff of lockable closure member 139 may also have indentations 153 along its entire convex surface, see for example FIG. 1 and the lowest part of FIG. 12. Those indentations may be more closely spaced, i.e. have a finer pitch, than the latch portions at the ends of the second and third ratchet cuffs, as shown in FIGS. 1 and 9-20.

Figure 7:
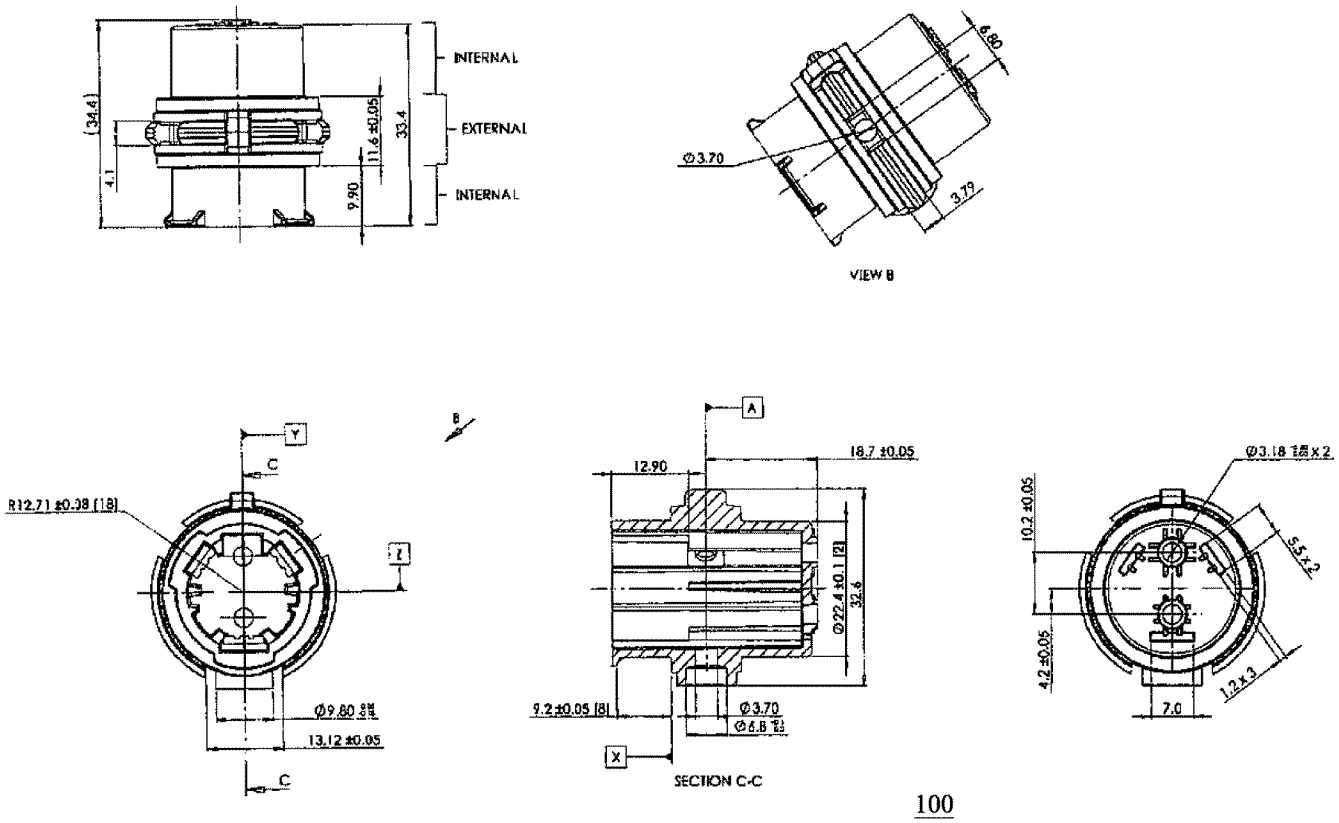

FIG. 7 shows various perspective and elevation views of housing 103. Housing 103 shows the main component of the body of the lock as shown at reference 101 in FIG. 1. The openings through which the pegs and teeth pass are visible, arrayed around the body of the housing.

Figure 8:
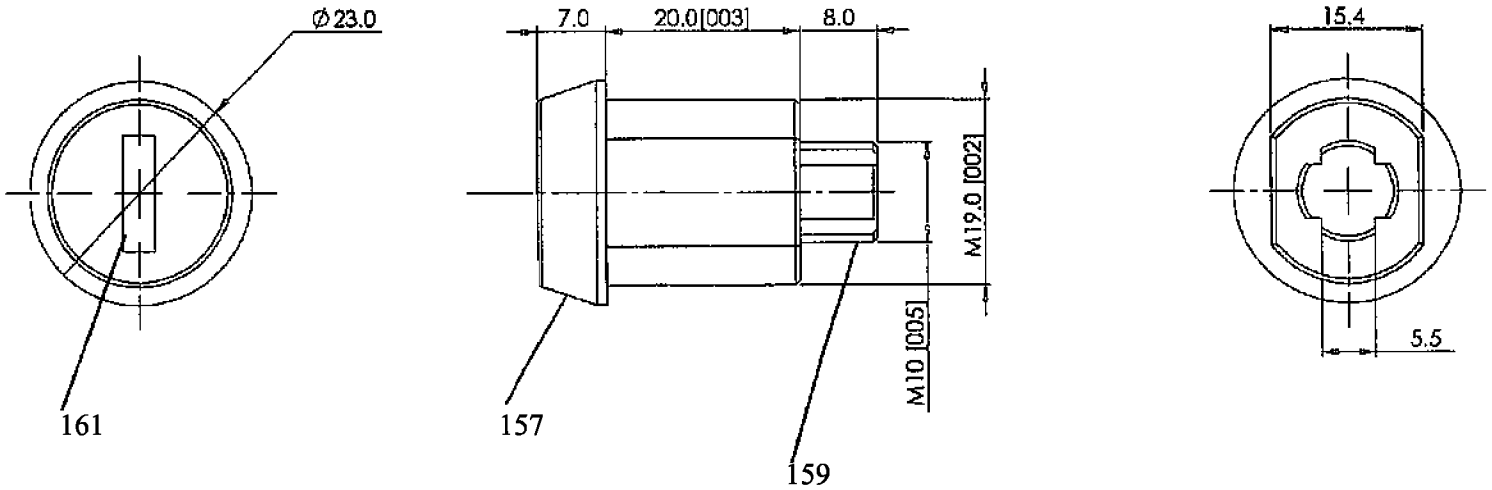

FIG. 8 shows various perspective and elevation views of a cam lock 155. Front face 157 of cam lock 155, after assembly of the ski locking device, will sit at the front of the ski locking device. The remainder of cam lock 155 lies within housing 103. Front face 157 is visible in FIG. 1, just above the point where reference 105 indicates the front portion of the housing 103. Rear portion 159 of cam lock 155, after assembly of the ski locking device, extends inside the housing 103. Rear portion 159 of cam lock 155 is not visible in any of FIGS. 1-7, and is not visible in normal operation of the ski locking device.

Also visible in FIG. 8 is slot 161. Slot 161 allows insertion and removal of a key, which is not shown on FIG. 8. The later figures provide further description of the use of the key.

Figure 9:
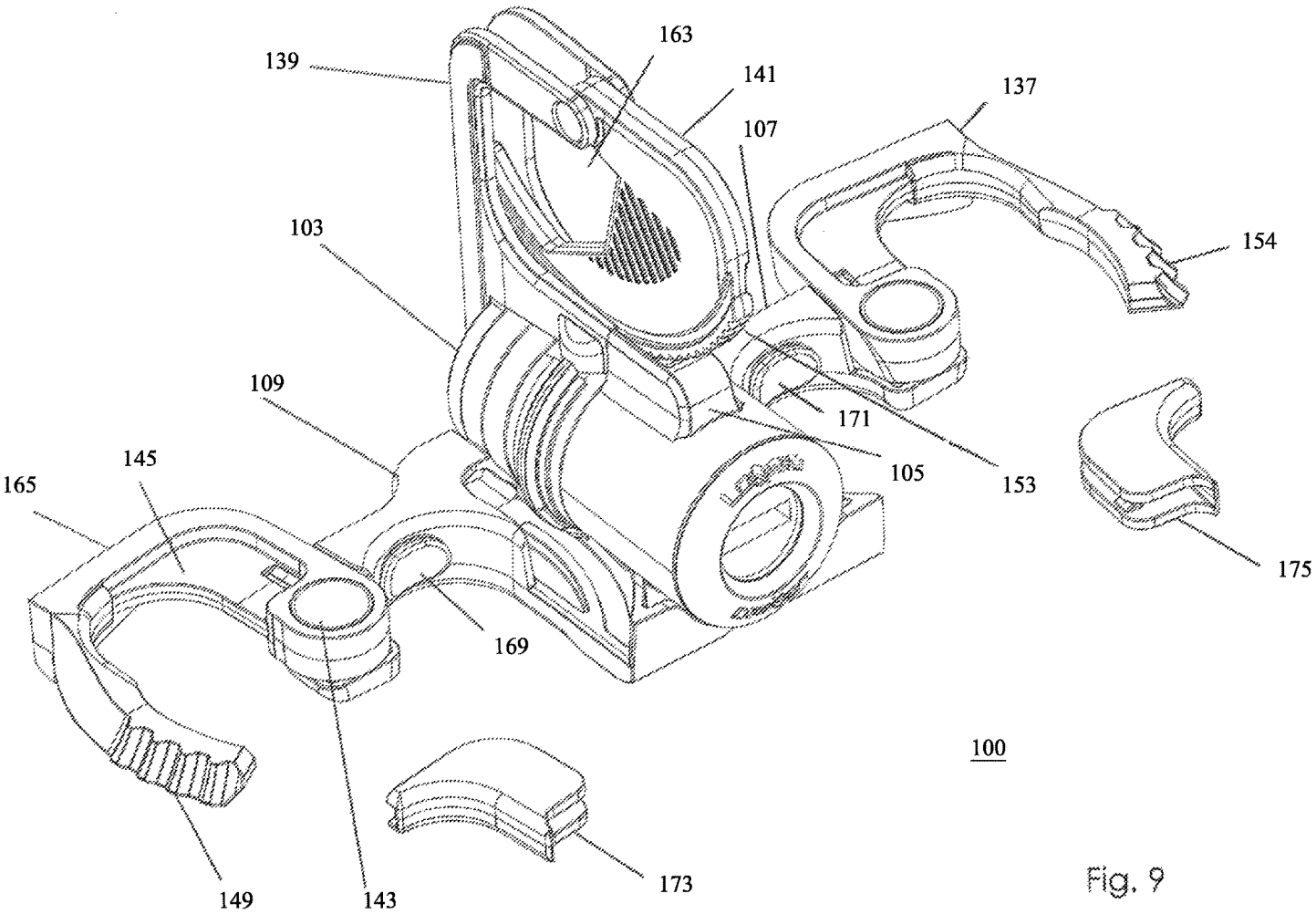

FIG. 9 shows a perspective view of ski locking device 100 in an inverted orientation. In order to understand the orientation of ski locking device 100 in FIG. 9, it is useful to compare FIG. 9 with FIG. 1. In FIG. 9, ski locking device is in an inverted orientation, relative to the orientation in FIG. 1. In the orientation shown in FIG. 9, ski locking device 100 is oriented with the lockable closure member 139 above the housing 103. Ski locking device 100 may then be used to lock a pair of skis, in an orientation with the lockable closure member above the housing. This contrasts with the orientation in FIG. 1, where the lockable closure member 139 is below the housing 103. Using the orientation in FIG. 1, the ski locking device would be used to lock a pair of skis, in an orientation with the lockable closure member 139 below the housing 103.

Continuing the comparison between FIG. 9 and FIG. 1, front portion 105 of housing 103 is shown. First arm 107 is to the right side of FIG. 9, due to the inverted orientation of ski locking device 100 relative to FIG. 1. Second arm 109 is to the left side of FIG. 9, due to the inverted orientation of ski locking device 100 relative to FIG. 1.

First ratchet cuff 141 pivots on the extremity of the fixed portion of lockable closure member 111. First ratchet cuff 141 is shown in the closed position in FIG. 9. However, no ski-bindings are in the aperture 163 created within lockable closure member 111 in the configuration illustrated in FIG. 9. First ratchet cuff 141 might, for example, be in the closed position shown in FIG. 9 when the ski locking device is not in use, and stowed away.

First ratchet cuff 141 has indentations 153 along most of its convex surface. This allows first ratchet cuff 141 to be locked into place against main body 101 in a wide variety of orientations. At one extreme, just the distal, thin end of first ratchet cuff 141 may be inserted far enough to be locked against main body 101. At one extreme, the distal, thin end of first ratchet cuff 141 may be inserted so far that it protrudes down into the fixed portion of lockable closure member 111, in which case the aperture 163 becomes very small. In this orientation, the last indentations on the convex edge of first ratchet cuff 141, at a point where first ratchet cuff 141 is thickest, will be locked against main body 101. Thus the length of the convex edge of first ratchet cuff 141 that carries indentations 153 will determine the range of closed positions in which first ratchet cuff 141 can be locked. This, in turn, determines the range of sizes of aperture 163 for surrounding, and possibly holding fast, the ski bindings that lie within aperture 163 when lockable closure member 111 is the 952 Second ratchet cuff 137 is shown in the open position. The various details of second ratchet cuff 137 in FIG. 9 can be seen from the design shown in FIG. 6. Indentations 154 constituting latch features are visible on the convex outer edge of second ratchet cuff 137.

Third ratchet cuff 165 is shown mounted on second arm 109. Third ratchet cuff 165 is shown in the open position. The various details of third ratchet cuff 165 in FIG. 9 can be seen from the design shown in FIG. 6. For example, thickened portion 145 of third ratchet cuff 165 is comparable to thickened portion 145 of ratchet cuff 141 in FIG. 6. Pivot point 143 is shown in FIG. 9. Latch features 149 of third ratchet cuff 165 are also shown in each of the four views in FIG. 6.

The inner edge of third arm 167 carries a pad 169. When the ski locking device is used to lock ski poles, those poles will abut pad 169. This prevents damage both to the inner edge of third arm 167, and to the enclosed ski pole. The inner edge of second arm 109 carries a similar pad 171.

Pole protection bumper 173 is shown disassembled from the remainder of ski locking device 100. Pole protection bumper 173 slides onto the inner edge of ratchet cuff 141, at the location of thickened portion 145. Pole protection bumper 173 prevents damage both to the inner edge of third arm 167, and to the enclosed ski pole. A similar pole protection bumper 175 is shown in front of second arm 109.

The components shown in FIGS. 1-9 are variously made from metals/alloys, and from non-metallic composite materials that have sufficient resilience.

FIGS. 10-20 form a sequence, which mainly describes the function and use of the ski locking device. This contrasts with FIGS. 1-9, which mainly describe the structure of the ski locking device.

Figure 10:
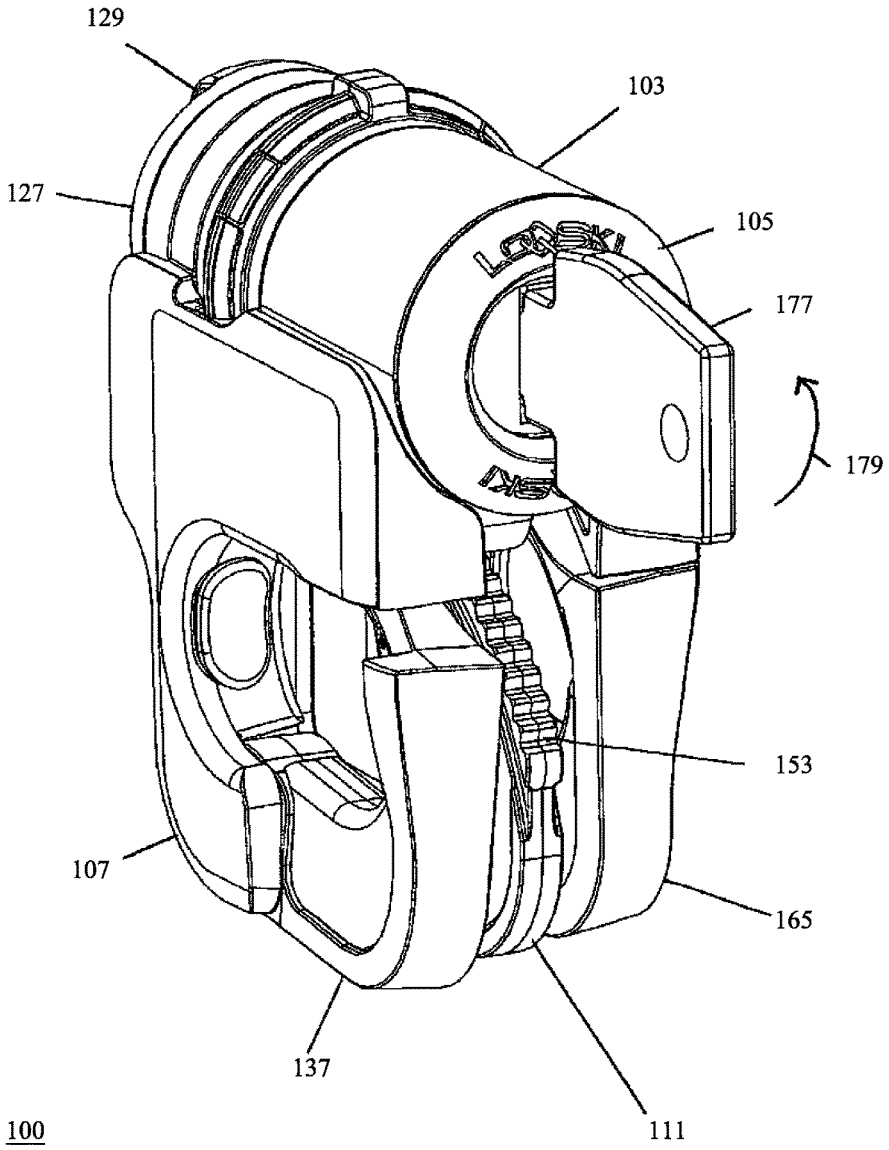
FIGS. 10-21 are primarily focussed on the function of the ski locking device.

During the sequence of FIGS. 10-20, the ski locking device will be described during various generally consecutive stages of its use. The starting position in FIG. 10 is with the ski locking device as it would normally be configured when it has been stored. Final FIG. 20 of this sequence shows the ski locking device locked around a pair of skis and poles. Tether 113 of the ski locking device is shown in FIG. 13, but not in FIGS. 10-12 and 14-21.

FIG. 10 is a perspective view of ski locking device 100, from the front. Unlike previous views, FIG. 10 shows ski locking device 100 from the side on which first arm 107 is located. FIG. 10 shows ski locking device as it would normally be configured when it has been stored. Thus FIG. 10 illustrates the configuration of ski locking device 100, for example, when a user removes ski locking device 100 from a pocket or rucksack, with the intention of using it to secure a pair of skis. Typically, a pair of ski poles would also be secured, and this application is also illustrated in the sequence of FIGS. 10-20.

FIG. 10 shows housing 103. Inserted into front portion 105 of housing 103 is a key 177. Prior to turning key 177, all the moveable components of ski locking device 100 may be locked and immovable. Arrow 179 indicates a direction in which a user will turn key 177, in order to unlock ski locking device 100. Key 177 may be turned through 90 degrees, i.e. a quarter turn, in order to unlock ski locking device 100. When ski locking device 100 is unlocked the key is not removable. The key is only removable once the ski locking device has been locked. The ski locking device may be configured such that, when key 177 turned through 180 degrees the first 107 and second arms 109 are unlocked, and at 270 degrees the central cuff is unlocked.

Towards the bottom left of FIG. 10, first arm 107 is visible. The first ratchet cuff of lockable closure member 111 is also visible at the lower centre of FIG. 10. Approximately seven of the indentations 153 on the outer convex edge of the first ratchet cuff are also visible. Second ratchet cuff 137 of first arm 107 is also visible at the lower front of FIG. 10. Third ratchet cuff 165 is also visible at the lower right front of FIG. 10.

Towards the back of housing 103, the rear portion 127 of housing 103 is visible. Central protruding portion 129 is also just visible, projecting beyond rear portion 127.

In FIG. 10, first arm 107, comprising second ratchet cuff 137 is in the first storage position, lying adjacent to a first side of the lockable closure member 111. Third ratchet cuff 165 is visible in FIG. 10, and indicates that the third ratchet cuff is in the second storage position, lying adjacent to a second side of the lockable closure member 111. However, although second ratchet cuff 137 is generally shown in the first storage position, second ratchet cuff 137 has been illustrated in a position where it has not been completely closed. A comparison of second ratchet cuff 137 and third ratchet cuff 165 in FIG. 10 shows that the bottom edge of second ratchet cuff 137 is slightly lower than third ratchet cuff 165. If second ratchet cuff 137 were completely closed, second ratchet cuff 137 and third ratchet cuff 165 would lie symmetrically either side of lockable closure member 111.

Figure 11:
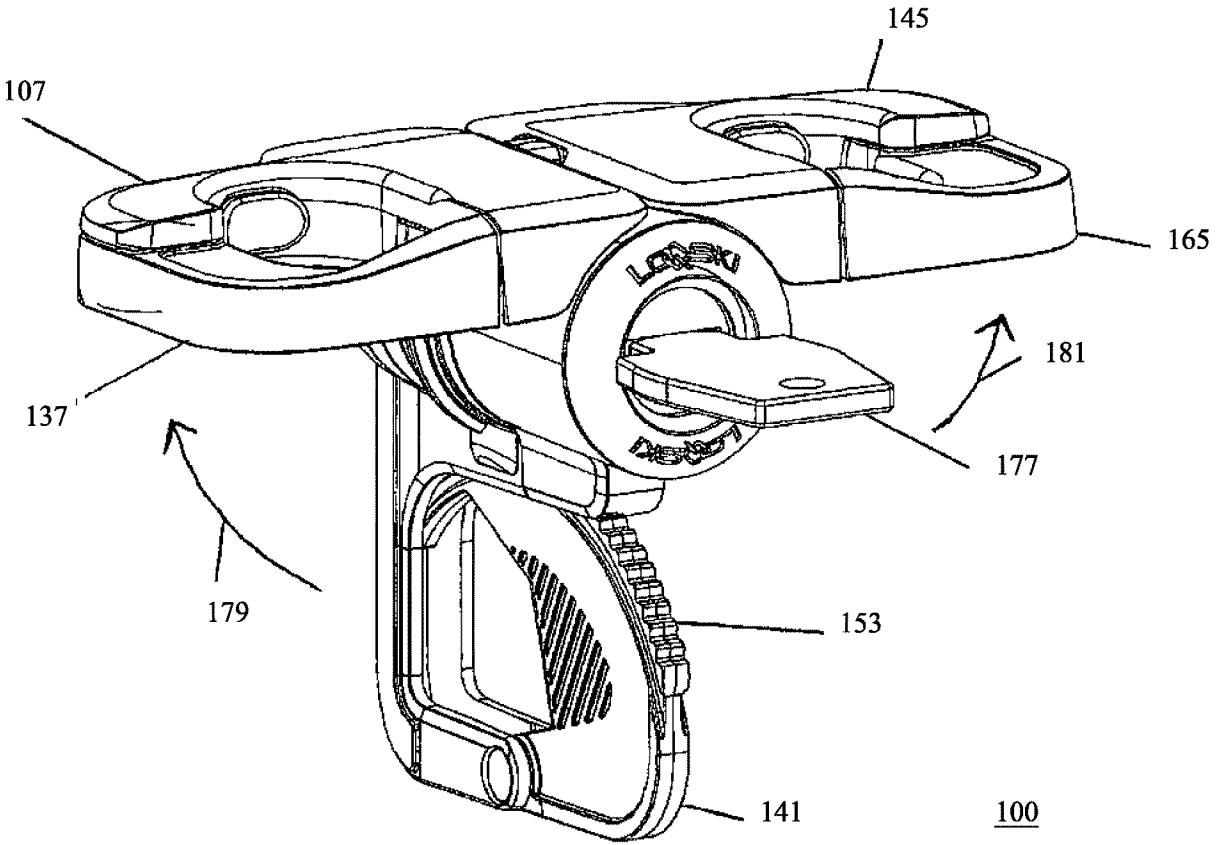

FIG. 11 is another perspective view of ski locking device 100, from the front, and subsequent to that in FIG. 10. FIG. 11 shows ski locking device 100 after key 177 has been turned through 90 degrees. All moveable parts of ski locking device 100 may now be unlocked. A user can therefore now start to move parts of ski locking device 100 into the correct positions to lock up a pair of skis.

A user has rotated first arm 107 from the first storage position to a first deployed position. Arrow 179 indicates the movement of first arm 107 from the first storage position to the first deployed position. The user has also rotated second arm 109 from the second storage position to the second deployed position. Arrow 181 indicates the movement of second arm 109 from the first storage position to the first deployed position. Indentations 153 on the convex outer edge of first ratchet cuff 141 are now more clearly visible. Approximately eight of indentations 153 are visible in FIG. 10.

In both FIGS. 10 and 11, and preceding FIGS. 1-5, second ratchet cuff 137 and third ratchet cuff 165 are shown in a closed configuration. In this closed configuration, only the thickened part 145 (see again FIG. 6) of each of second ratchet cuff 137 and third ratchet cuff 165 is visible.

Figure 12:
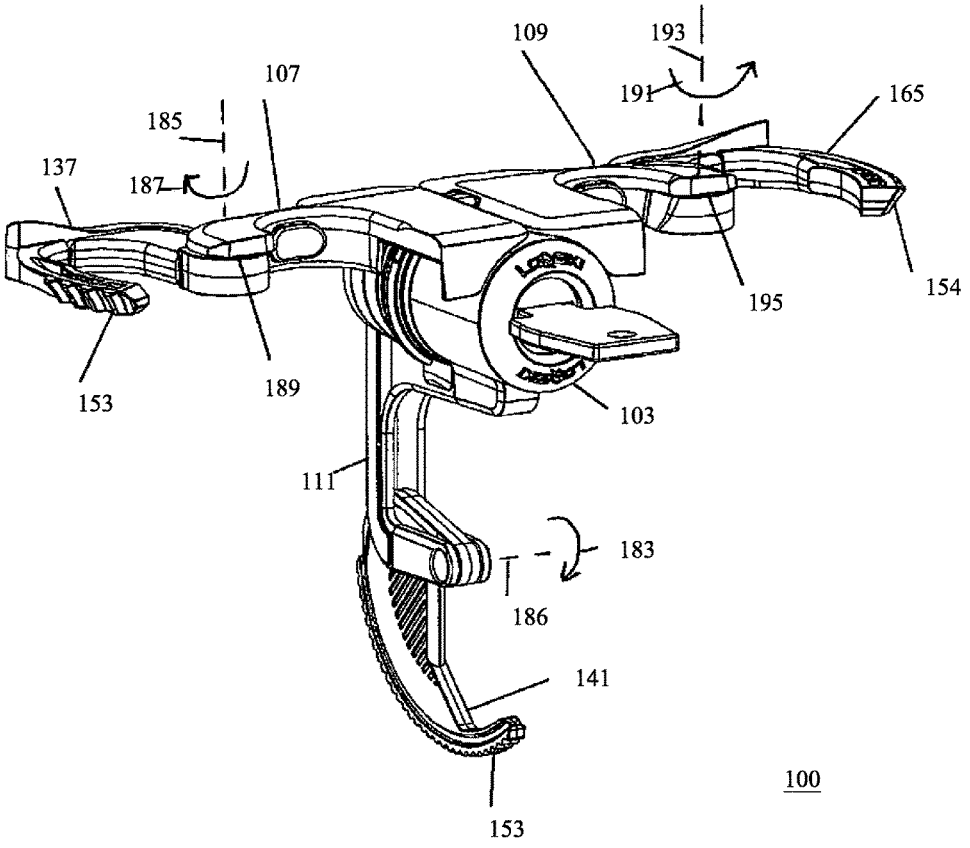
Figure 13:
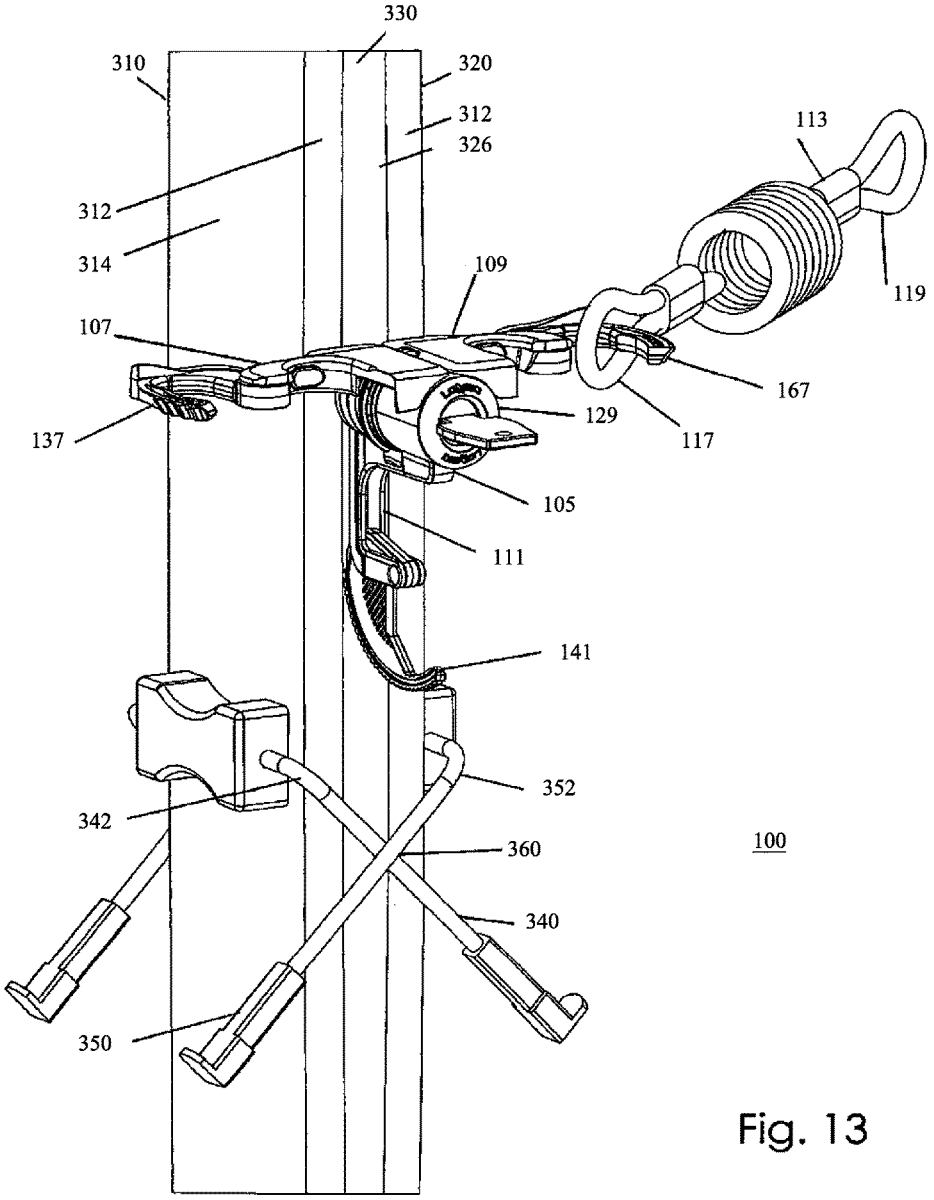

FIG. 12 is another perspective view of ski locking device 100, from the front, and subsequent to that in FIG. 11. FIG. 12 illustrates the operation of opening the first-, second- and third ratchet cuffs.

First ratchet cuff 141 is now clearly visible. First ratchet cuff 141 has moved in the direction shown by arrow 183. This has involved rotation about an axis 186. This rotation occurs around the point at which first ratchet cuff 141 is attached to the remainder of lockable closure member 111. All of lockable closure member 111, except for first ratchet cuff 141, may be rigidly attached to the lower edge of housing 103.

First ratchet cuff 141 comprises indentations 153. Indentations 153 may run all the way to the distal end of first ratchet cuff 141. The proximal part of first ratchet cuff 141 that does not show indentations 153 may also be of narrower width than portion 147 of the second and third ratchet cuffs as illustrated in FIG. 6.

Second ratchet cuff 137 is now also clearly visible towards the left of FIG. 12. Second ratchet cuff 137 has moved in the direction shown by arrow 187. This has involved rotation about an axis 185. This rotation occurs around the point 189 at which second ratchet cuff 137 is attached to the remainder of first arm 107. Second ratchet cuff 137 comprises indentations 153.

Third ratchet cuff 165 is now also clearly visible towards the right of FIG. 12. Third ratchet cuff 165 has moved in the direction shown by arrow 191. This has involved rotation about an axis 193. This rotation occurs around the point 195 at which third ratchet cuff 165 is attached to the remainder of second arm 109. Second ratchet cuff 137 comprises indentations 154.

FIG. 13 provides a perspective view of the ski locking device when placed against a pair of skis. The configuration of the ski locking device itself in FIG. 13 is similar to that shown in FIG. 12. The skis themselves do not form part of the ski locking device. For this reason, the skis have been given reference numerals of the format '3xx', in order to distinguish them from the reference numerals '1xx and 2xx" used for components of the ski locking device throughout the drawings.

First ski 310 has a first edge 312 and a non-sliding surface 314. Surface 314 is the upper surface of the ski, when the ski is placed on the ground for normal use. The sliding surface of first ski 310 is not visible in FIG. 13. First ski 310 also has a first snow-brake 340, which is visible in the lower part of FIG. 13. First snow-brake 340 has a first shoulder 342.

Second ski 320 has a second edge 322 and a sliding surface 326. The non-sliding surface of second ski 320 is not visible in FIG. 13. Second ski 320 also has a second snow-brake 350, which is also visible in the lower part of FIG. 13. Second snow-brake 350 has a second shoulder 352.

First ski 310 and second ski 320 have been placed in their storage configuration. This means that the sliding surfaces of both skis face or abut each other. Typically, the sliding surfaces of the skis touch at their ends, but there may be a gap between the skis in their mid-portions, as is illustrated in FIG. 13. Gap 330 is shown towards the top of FIG. 13. First snow-brake 340 and second snow-brake 350 cross at crossing point 360.

Front portion 105 of the ski locking device is illustrated towards the front of FIG. 13. Lockable closure member 111 can be seen, but part of lockable closure member 111 lies in gap 330 between first ski 310 and second ski 320. First ratchet cuff 141 lies generally above the crossing point 360 of first snow-brake 340 and second snow-brake 350.

The central protruding portion 129 of housing 103 shown on FIG. 2 is not visible in FIG. 13, as it has been pushed into gap 330 between first ski 310 and second ski 320. In this situation, rear portion 127 shown in FIG. 2 now abuts first edge 312 of first ski 310, and second edge 322 of second ski 320. Central protruding portion 129 may help guide the ski locking device as a user moves it downwards or upwards, towards the point where the first ratchet cuff passes behind the crossing point of the ski brakes.

First arm 107 of the ski locking device may also abut first edge 312 of first ski 310. Second ratchet arm 109 remains free to rotate, i.e. to open and close. Second arm 109 may also abut second edge 322 of second ski 320. Third ratchet arm 167 remains free to rotate, i.e. to open and close.

When the separation between the edges of the skis and the crossing point of the snow brakes is relatively small, central protruding portion 129 may lie between the slide surface of the first ski 310 and the slide surface 326 of the second ski 320, when the ski locking device is in a closed position. With other designs of ski, which have a larger separation between the edges of the skis and the crossing point of the snow brakes, central protruding portion 129 may not extend into the gap 330 between the slide surface of the first ski 310 and the slide surface 326 of the second ski 320, when the ski locking device is in a closed position.

Tether 113 is shown in FIG. 13. Tether 113 has first loop 117 and second loop 119. Tether 113 is illustrated with third ratchet arm 167 inserted through first loop 117. In an alternative arrangement not illustrated in FIG. 13, the tether may be anchored on the top of the housing of the ski locking device, and rotate about a point at which the tether is anchored. Using this rotation, a user can move the tether to a position in which the user has access to the other parts of the ski locking device.

Figure 14:
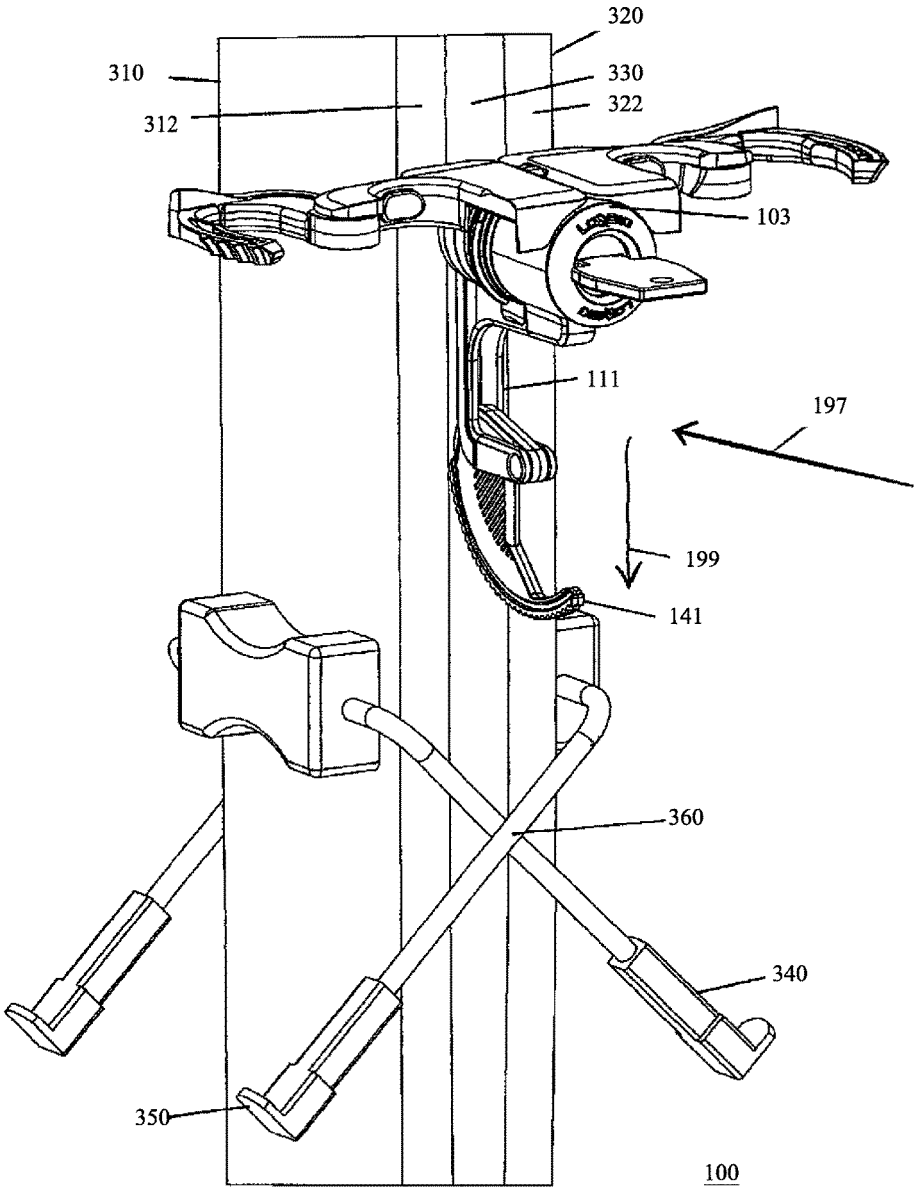

FIG. 14 provides a perspective view of the ski locking device when placed against a pair of skis, similar to that shown in FIG. 13. In FIG. 14, the configuration of the ski locking device is the same as in FIG. 13. Part of lockable closure member 111 remains in the gap 328 between first ski 310 and second ski 320. Rear portion 127 shown in FIG. 2 abuts first edge 312 of first ski 310, and second edge 322 of second ski 320. The central protruding portion 129 shown on FIG. 2 remains in gap 330 between first ski 310 and second ski 320. Rear portion 127 shown in FIG. 2 abuts first edge 312 of first ski 310, and second edge 322 of second ski 320.

Arrow 197 indicates the direction of insertion of the ski locking device to bring it to the position shown in FIGS. 13 and 14. Arrow 197 also indicates the direction of a force that a user may continue to apply to the ski locking device, in order to keep the rear portion of the housing against first edge 312 of first ski 310, and second edge 322 of second ski 320.

Arrow 199 indicates a direction in which the ski locking device will next move. A user will push the ski locking device downwards, in the direction of arrow 199. The aim is to pass first ratchet cuff 141 behind the crossing point 360 of first snow-brake 340 and second snow-brake 350. The user may push the top of housing 103 in order to move the ski locking device in the direction of arrow 199. However, given the relatively compact dimensions of the ski locking device, the user may also or instead grasp other portions of the ski locking device in order to apply a downward force to it.

Figure 15:
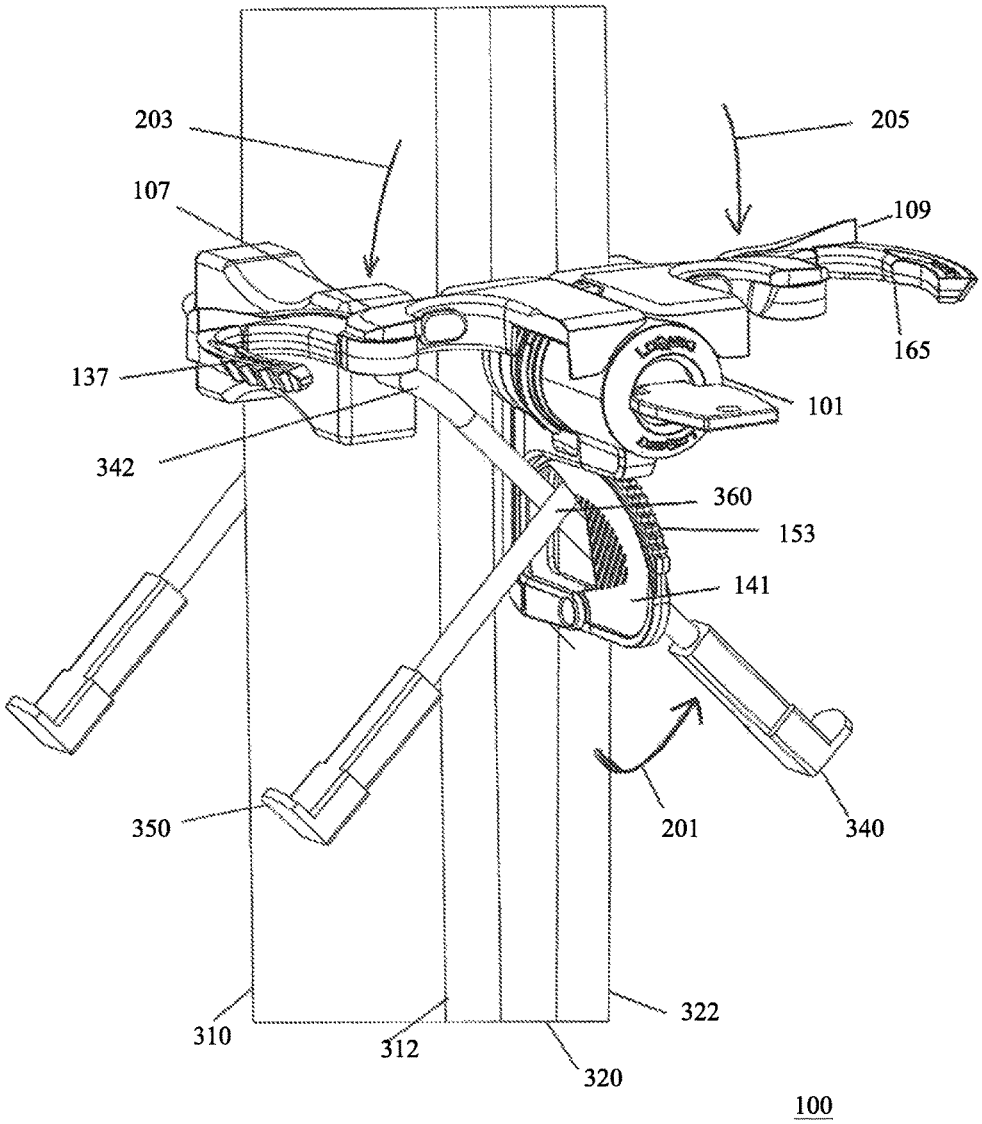

FIG. 15 provides a perspective view of the ski locking device locked around the crossing point 360 of the snow-brakes. Main body 101 of the ski locking device lies just above the crossing point 360 of the snow-brakes. Main body 101 lies close to or at the position of the first shoulder 342 of first snow-brake 340, and second shoulder 352 of second snow-brake 350, see again FIG. 13.

Arrow 201 indicates the direction in which first ratchet cuff 141 has pivoted. First ratchet cuff 141 has passed behind, underneath and around the crossing point 360 of first snow-brake 340 and second snow-brake 350. First ratchet cuff 141 has engaged with the bottom of the main body 101 of the ski locking device. The indentations 153 visible on first ratchet cuff 141 engage with a ratchet mechanism that is not visible in FIG. 15, to hold first ratchet cuff 141 in the position shown in FIG. 15. Arrow 203 indicates that the user may move first arm 107 and second ratchet cuff 137 downwards. Arrow 205 indicates that the user may move second arm 109 and third ratchet cuff 165 downwards.

Although not illustrated in FIG. 15, in an alternative embodiment first arm 107 may be configured such that an edge of the first arm extends behind the first edge 312 of the first ski 310, and over a non-slide surface of the first ski. Second arm 109 may be configured such that an edge of second arm 109 extends behind the second edge 322 of the second ski 320 and over a non-slide surface of the second ski. This arrangement helps prevent separation of the skis, when the ski locking device is in a closed position locking a pair of skis.

Figure 16:
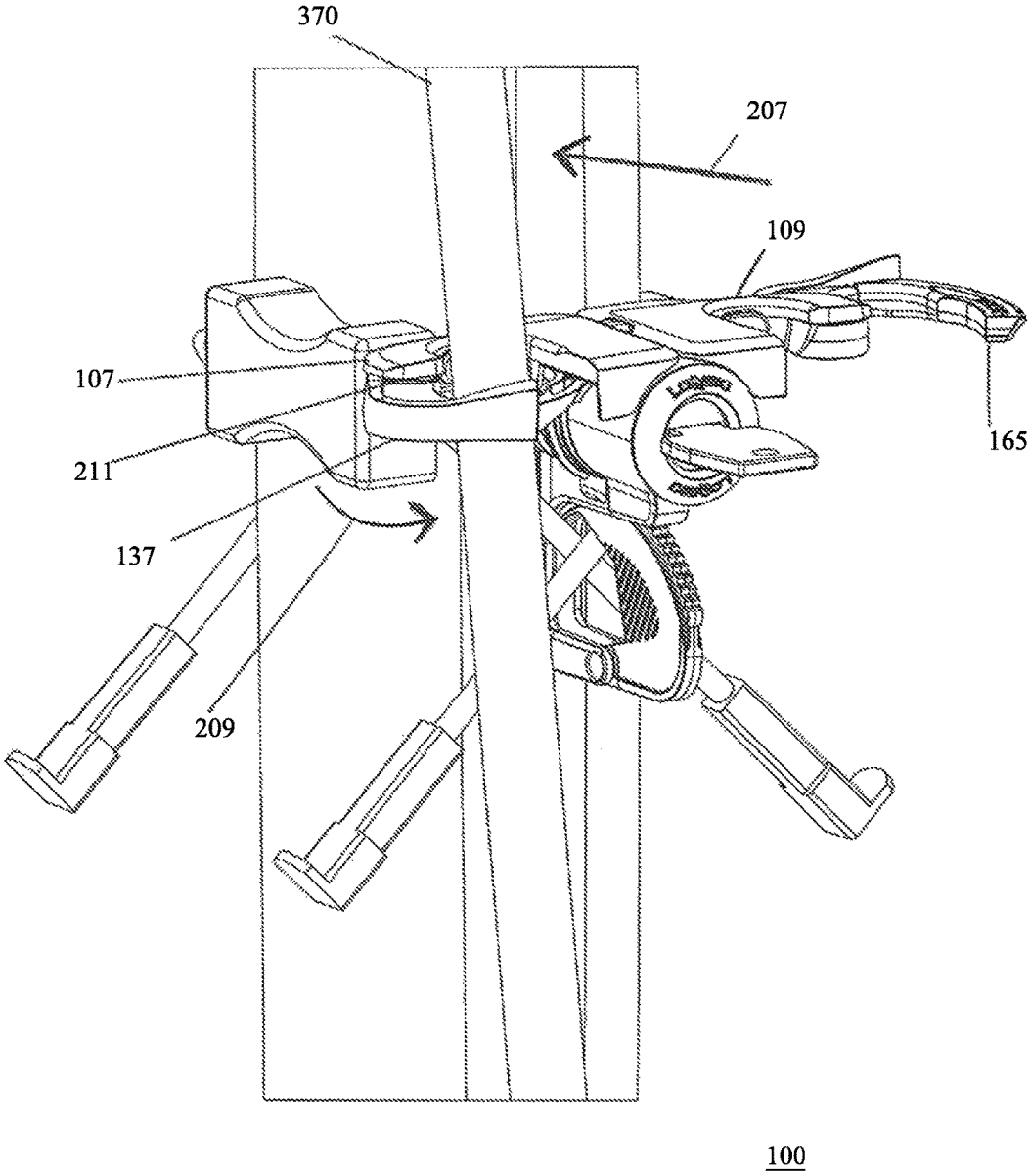

FIG. 16 provides a perspective view of the ski locking device locked around the crossing point of the snow-brakes. The view in FIG. 16 is subsequent to that in FIG. 15. A first ski pole 370 has been moved in the direction shown by arrow 207. This movement placed first ski pole 370 into the opening created by second ratchet cuff 137. This can be understood from a comparison of the position of second ratchet cuff 137, which is closed in FIG. 16, with the position of second ratchet cuff 137 in FIG. 15.

Arrow 209 indicates a direction in which second ratchet cuff 137 has pivoted about the point 211 where it is attached to the remainder of first arm 107. Second ratchet cuff 137 has engaged with the remainder of first arm 107 of the ski locking device. The indentations of second ratchet cuff 153 have engaged with a ratchet mechanism that is not visible in FIG. 16, i.e. second tooth 133 in FIG. 3, to hold second ratchet cuff 137 in the position shown in FIG. 16. The indentations are illustrated as reference 153 on FIG. 6 and as reference 153 on FIG. 9, for example. Third ratchet cuff 165 remains open and unlocked. The remainder of second arm 109 remains in the position shown in FIGS. 14 and 15.

Figure 17:
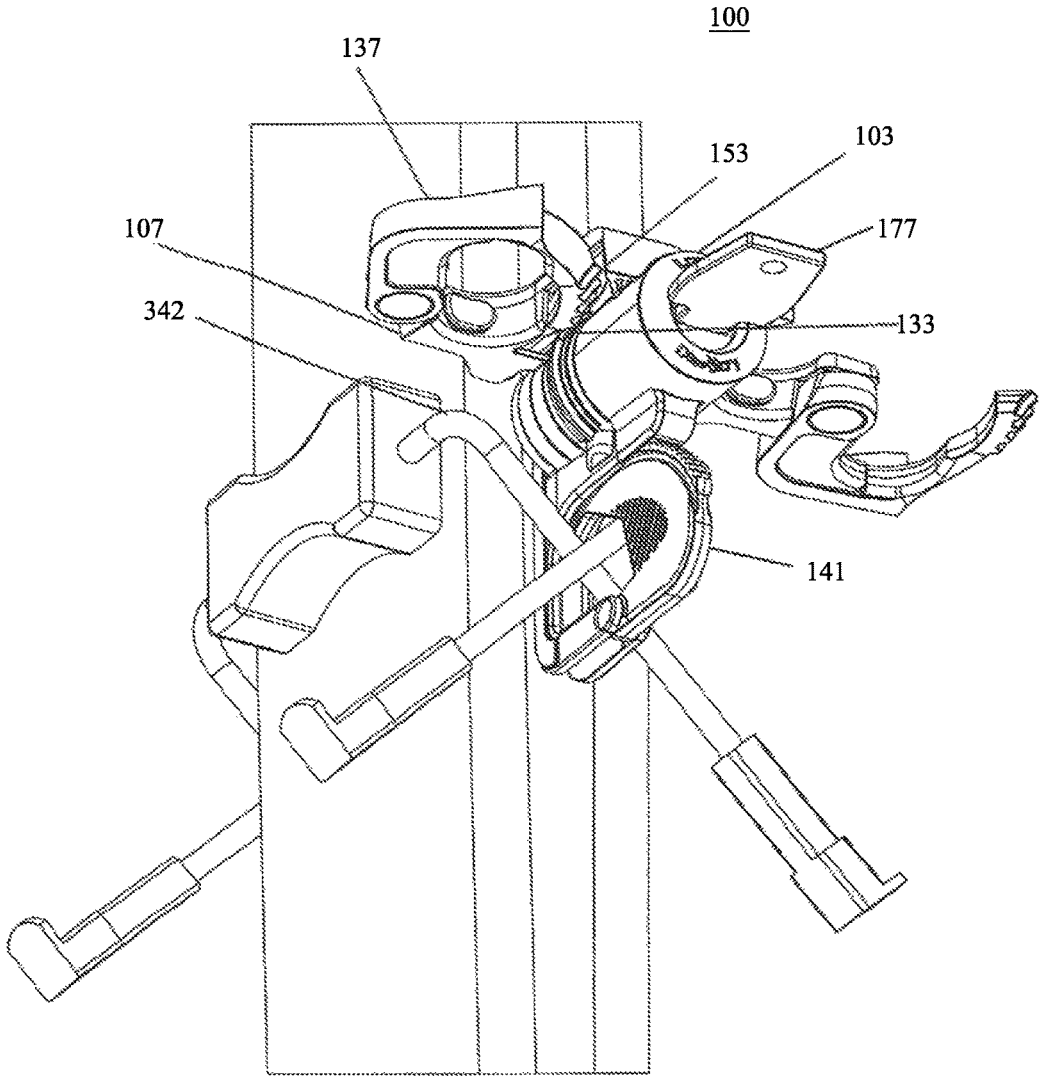

FIG. 17 provides a perspective view from below of the ski locking device in the configuration of FIG. 16. However, for clarity, the first ski pole has been omitted from FIG. 17.

Second ratchet cuff 137 remains closed. Indentations 153 on second ratchet cuff 137 are visible on FIG. 17. Second tooth/peg 133 is also visible on housing 103 of the ski locking device. A clearer view of the form of second tooth 133 is visible from first actuator 131 in FIG. 2, although second tooth 133 is located on the opposite side of housing 103 than first tooth 131 shown in FIG. 2. Second tooth 133 has engaged with the indentations 153 on second ratchet cuff 137, to hold second ratchet cuff 137 in position. First shoulder 342 of first snow brake 340 may help to prevent movement of the ski locking device downwards, since first arm 107 may be blocked by first shoulder 342.

If key 177 were now turned back to the vertical position shown in FIG. 10, then first ratchet cuff 141 and second ratchet cuff 137 would both be locked. Second tooth 133 would then be locked rigidly into position, and could not be depressed radially inwards towards housing 103 to allow passage of indentations 153 over it. When in the unlocked state, in contrast, second tooth 133 can be depressed radially inwards towards housing 103, to allow indentations 153 and second ratchet cuff 137 to pass freely in either direction. When in the unlocked state, second tooth 133 is only held in position by a spring force, which can easily be overcome by a user pulling or pushing second ratchet cuff 137.

Figure 18:
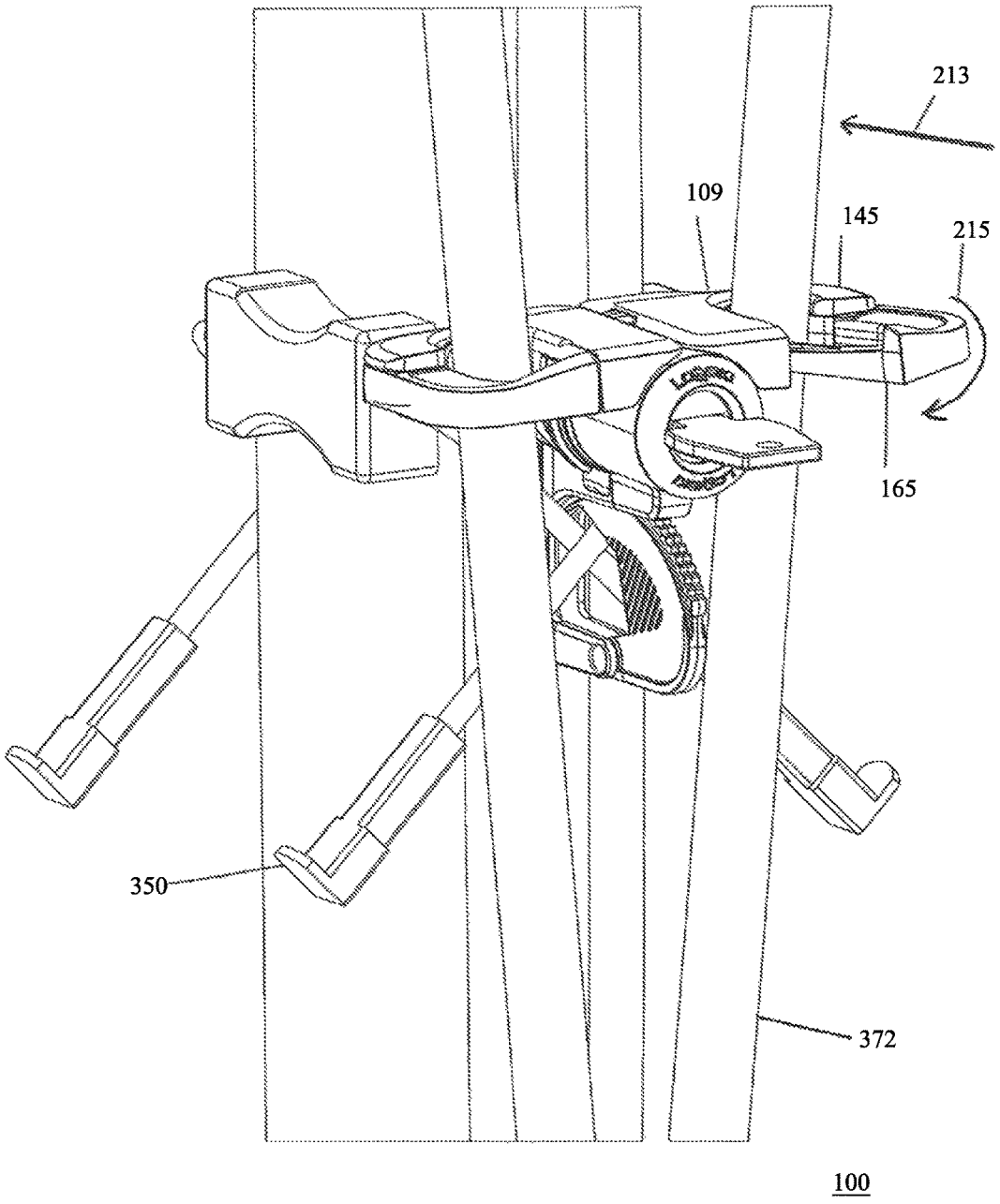

FIG. 18 provides another perspective view of the ski locking device locked around the crossing point of the snow-brakes.

FIG. 18 illustrates the closing of third ratchet cuff 165 around a second ski pole 372. FIG. 16 shows an action similar to that in FIG. 16. Second ski pole 372 has been moved in the direction shown by arrow 213. This movement placed second ski pole 372 into the opening created by third ratchet cuff 165. This can be understood from a comparison of the position of third ratchet cuff 165 with the position of third ratchet cuff 165 shown in FIG. 15 and third ratchet cuff 165 shown in FIG. 16.

Arrow 215 indicates a direction in which third ratchet cuff 165 has pivoted about the point where it is attached to the remainder of second arm 109. Third ratchet cuff 165 has engaged with the remainder of second arm 109 of the ski locking device. The indentations of second ratchet cuff 137 have engaged with a ratchet mechanism that is not visible in FIG. 18, to hold second ratchet cuff 137 in the position shown in FIG. 18, i.e. with third tooth 131 visible in FIG. 3. The indentations are illustrated as reference 153 on FIG. 6 and reference 153 on FIG. 9.

Figure 19:
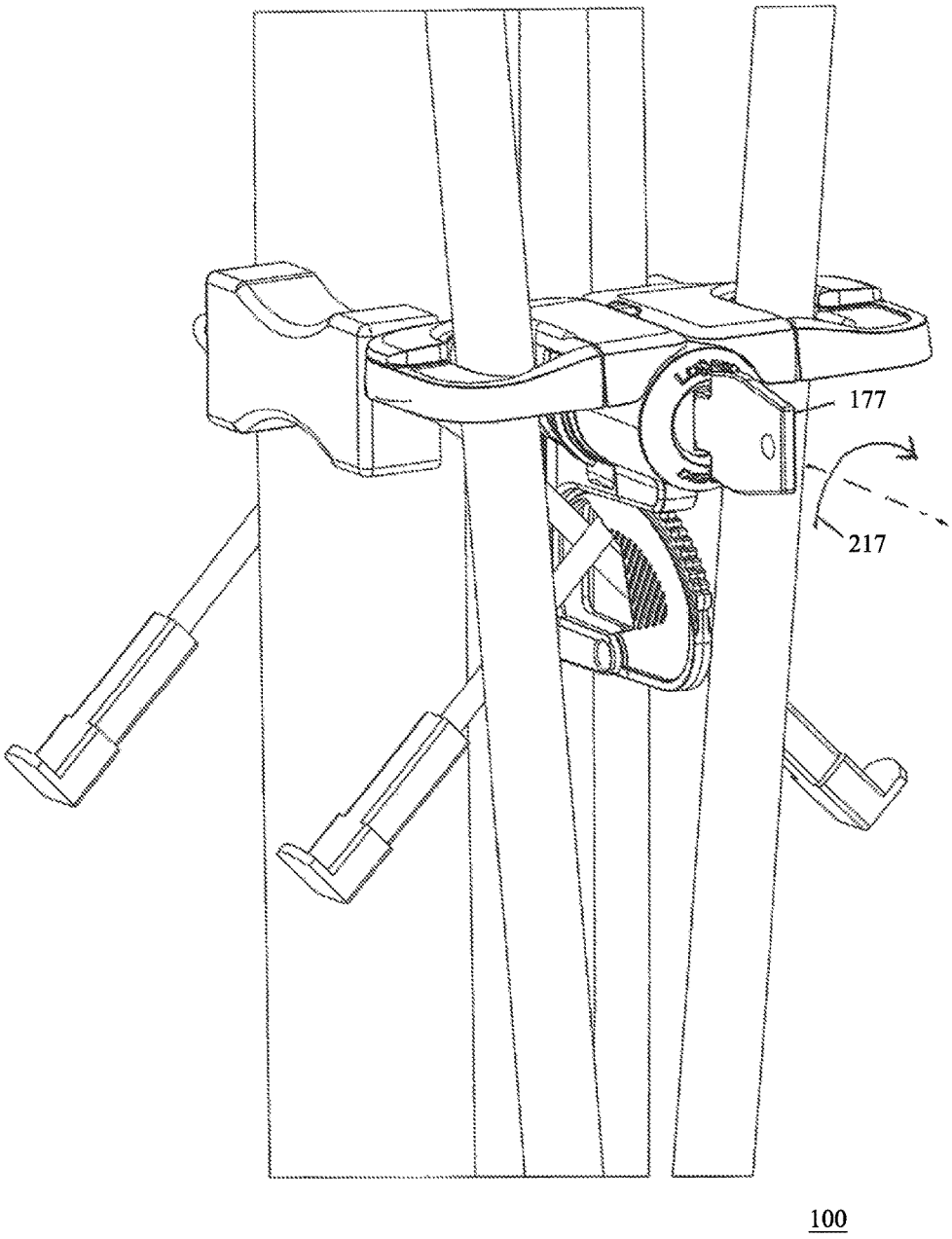

FIG. 19 shows the action of locking the ski locking device. Key 177 has been turned through a quarter turn in the direction shown by arrow 217 (clockwise). Key 177 can be removed, when oriented as shown in FIG. 19.

Figure 20:
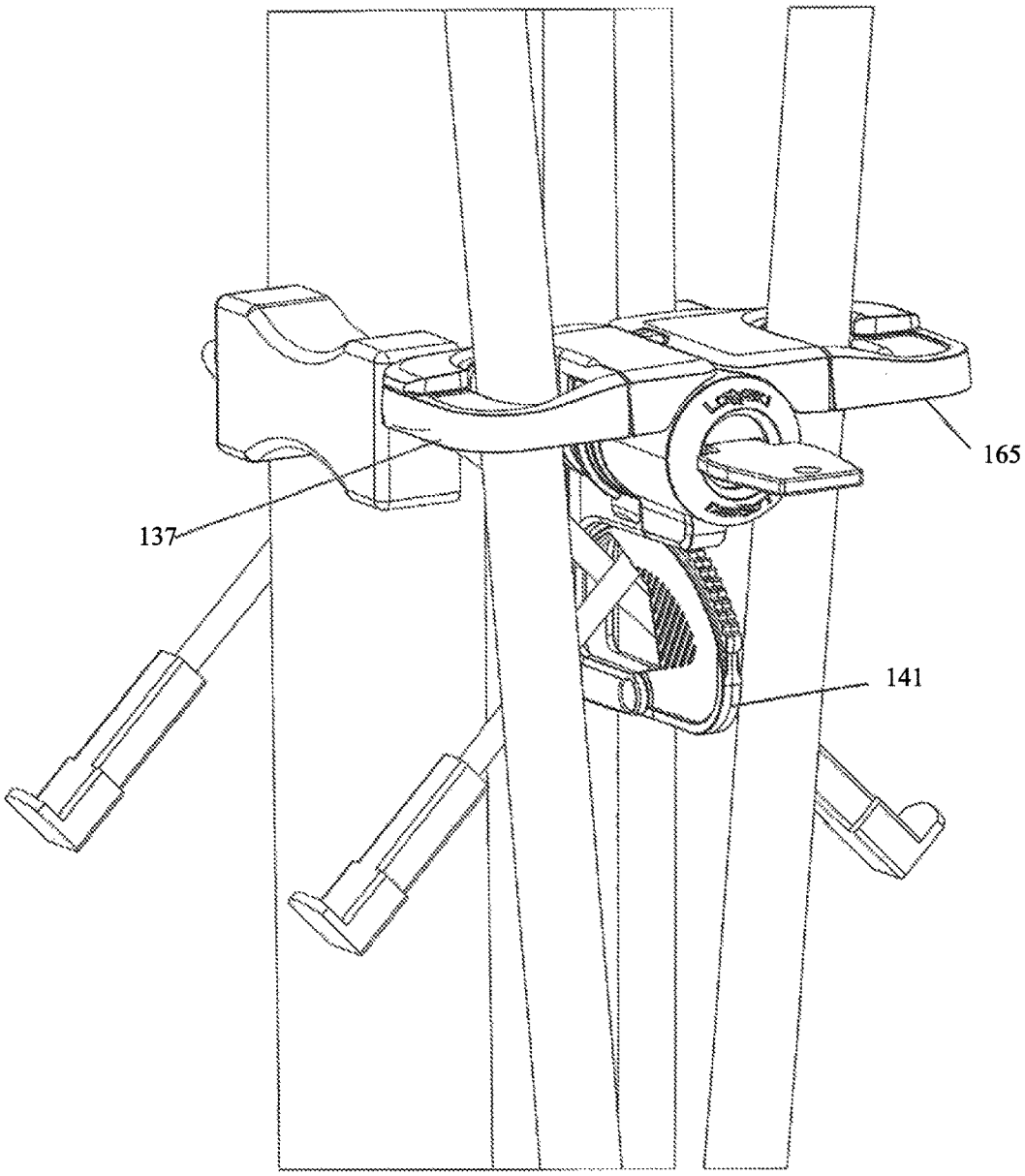

FIG. 20 illustrates the locked state of the moving parts of the ski locking device. First ratchet cuff 141 is now locked in position. Second ratchet cuff 137 is now locked in position. Third ratchet cuff 165 is now locked in position. The single quarter turn of key 177 shown in FIG. 19 simultaneously locks each of the three ratchet cuffs.

The configuration of the ski locking device shown in FIG. 20 is the final configuration. The skis are locked to each other. Each of the ski poles is also locked. The triple locking action ensures that it would require tremendous force to remove the ski locking device. A user would have great difficulty gaining 'purchase' on the device, in order to try and exert any force on it. In addition, close component tolerances for the constituent parts of the ski locking device ensure that it is very difficult to rock or build up momentum in any attempt to twist the ski lock off.

Tether 113 shown in FIG. 13 may be used to secure the locking device and locked skis and poles to another object, which is preferably an immovable object. For example, tether 113 may be passed around a ski rack. Then first loop 117 and second loop 119 may be placed into one of the open arms 107 or 109, or possibly the lockable closure member 111. When the ratchet(s) concerned is/are closed and locked, first loop 117 and second loop 119 will also be locked in place.

Figure 21:
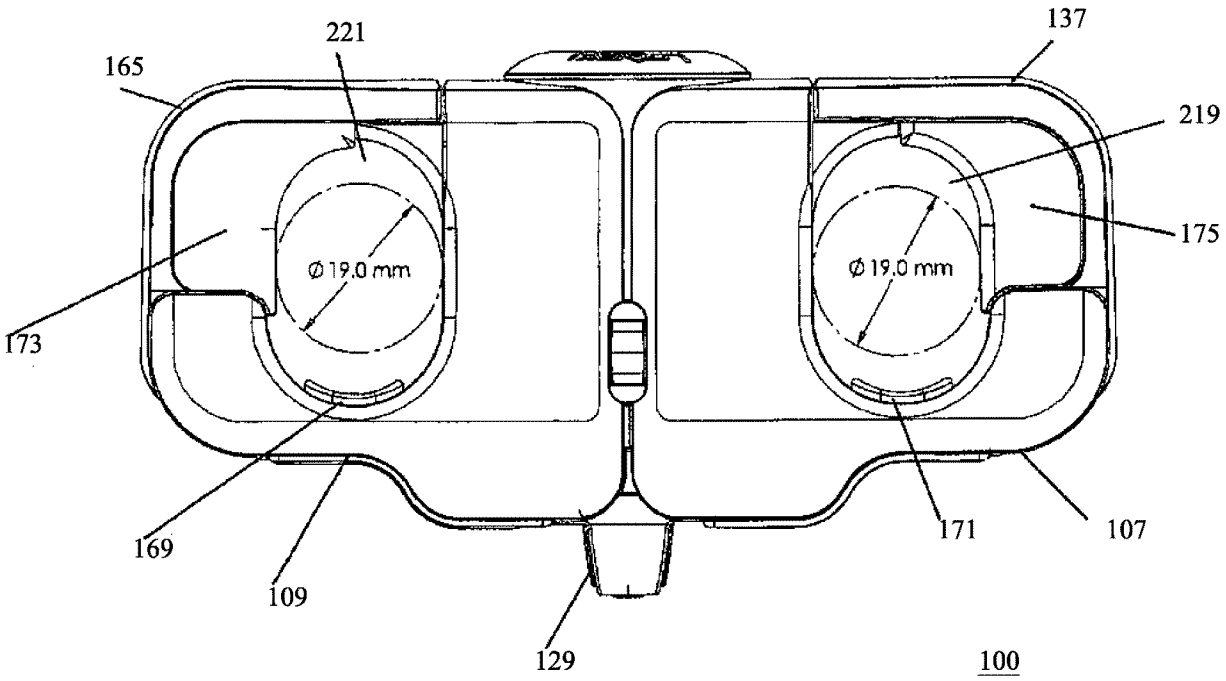

FIG. 21 shows a plan view of the ski locking device 100. First arm 107 and second arm 109 have been rotated from the first and second storage positions into the deployed position. This movement is shown by arrows 179 and 181 in FIG. 11.

Second ratchet cuff 137 and third ratchet cuff 165 are in the closed positions. A second aperture 219 provides an opening in which a ski pole of up to a diameter of 19 mm may be located. A third aperture 221 provides an opening in which a ski pole of up to a diameter of 19 mm may be located.

Pad 169 and pole protection bumper 173 are shown in FIG. 21. Notably, in FIG. 21, pole protection bumper 173 has been illustrated in an assembled configuration, where pole protection bumper 173 has been placed onto third ratchet cuff 165. This is in contrast to the dis-assembled configuration, illustrated in FIG. 9. Pad 169 and pole protection bumper 173 may help to prevent damage to a ski pole located in third aperture 221.

A similar arrangement is provided by pad 171 and pole protection bumper 175. In FIG. 21, pole protection bumper 175 has been illustrated in an assembled configuration, where pole protection bumper 175 has been placed onto second ratchet cuff 137. This is in contrast to the dis-assembled configuration, illustrated in FIG. 9. Pad 171 and pole protection bumper 175 may help to prevent damage to a ski pole located in second aperture 219.

Protruding portion 129 of the ski locking device 100 is visible at the lower edge of FIG. 21.

Figure 22:
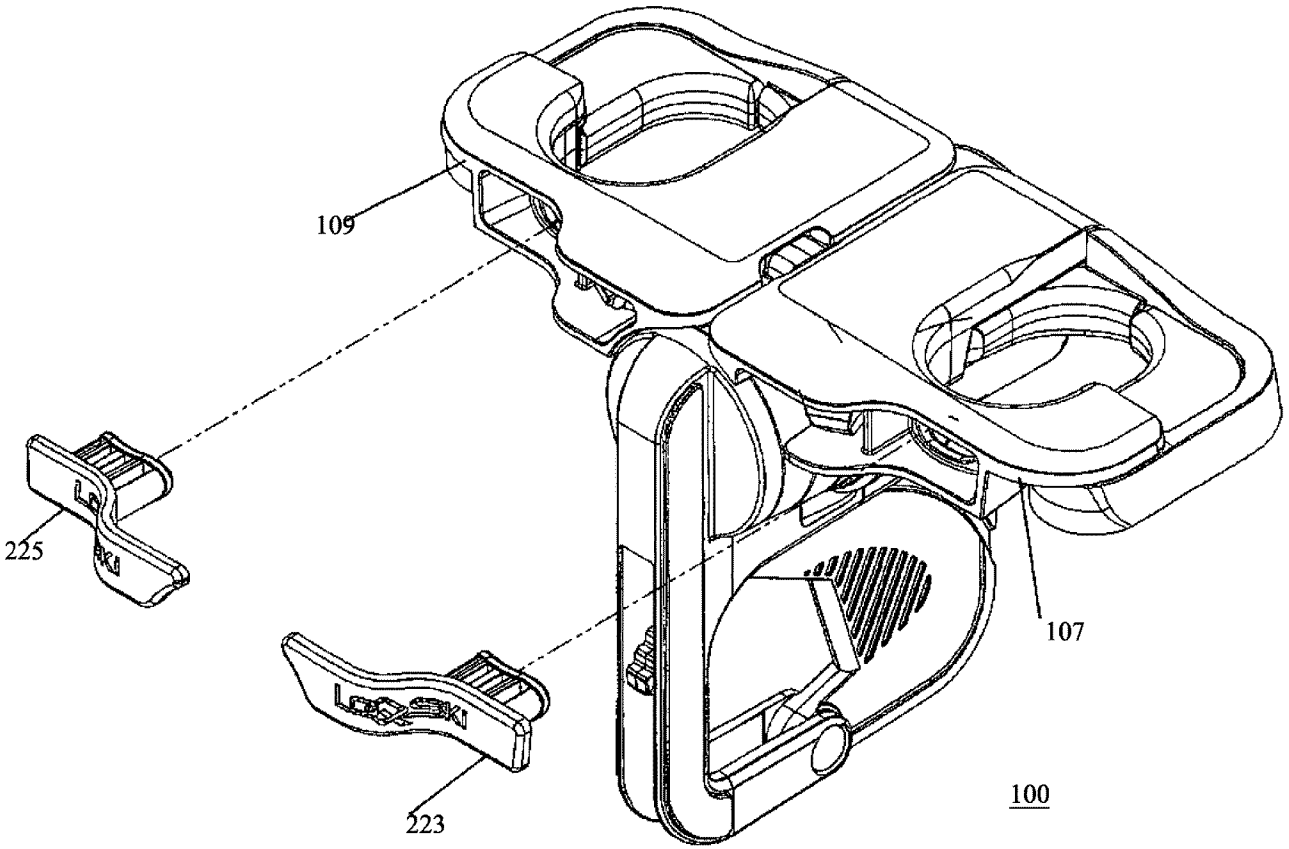
FIG. 22 illustrates a rear perspective view of the ski locking device.

FIG. 22 shows a rear perspective view of the ski locking device 100. First insert 223 is shown disassembled from first arm 107. First insert 223 may be fitted into the outer edge of the fixed portion of first arm 107. Similarly, second insert 225 is shown disassembled from second arm 109. Second insert 225 may be fitted into the outer edge of the fixed portion of second arm 109. First insert 223 and second insert 225 may form the contact surfaces between ski locking device 100 and the edges of the skis to which ski locking device 100 is fitted. This arrangement of first insert 223 prevents direct metal to metal contact between first arm 107 and the ski that abuts or lies behind the fixed portion of first arm 107. Similarly, second insert 225 prevents direct metal to metal contact between second arm 109 and the ski that abuts or lies behind the fixed portion of second arm 109. A consequence may be less wear on the ski locking device 100 and on the skis to which it is attached. First insert 223, if made of plastic, rubber or other material that is a poor thermal conductor and/or is soft, may provide an enhanced feel to ski locking device 100 for the user.

Figure 23:
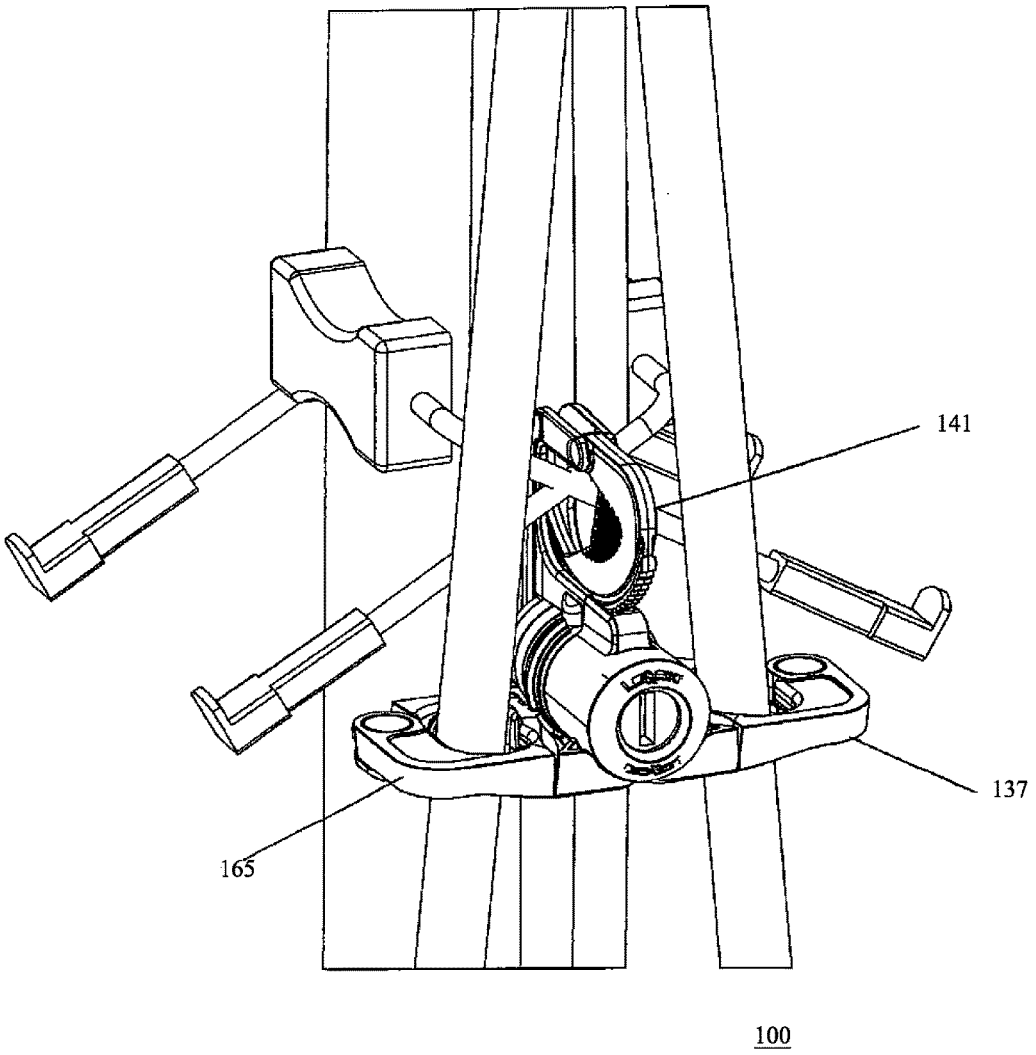
FIG. 23 illustrates a perspective view of the ski locking device locked around the crossing point of the snow-brakes, in an inverted orientation.

FIG. 23 illustrates a perspective view of the ski locking device locked around the crossing point of the snow-brakes, in an inverted orientation. FIG. 9 also shows an inverted orientation. The locked configuration of the arms of the ski locking device in FIG. 23 is comparable to the locked configuration illustrated in FIG. 20.

FIG. 23 illustrates the locked state of the moving parts of the ski locking device, in the inverted orientation. First ratchet cuff 141 is now locked in position. Second ratchet cuff 137 is now locked in position. Second ratchet cuff 137 is towards the lower right of FIG. 23, in contrast to the location of second ratchet cuff 137 in FIG. 20. Third ratchet cuff 165 is now locked in position. Third ratchet cuff 165 is towards the lower left of FIG. 23, in contrast to the location of third ratchet cuff 165 in FIG. 20.

Figure 24:
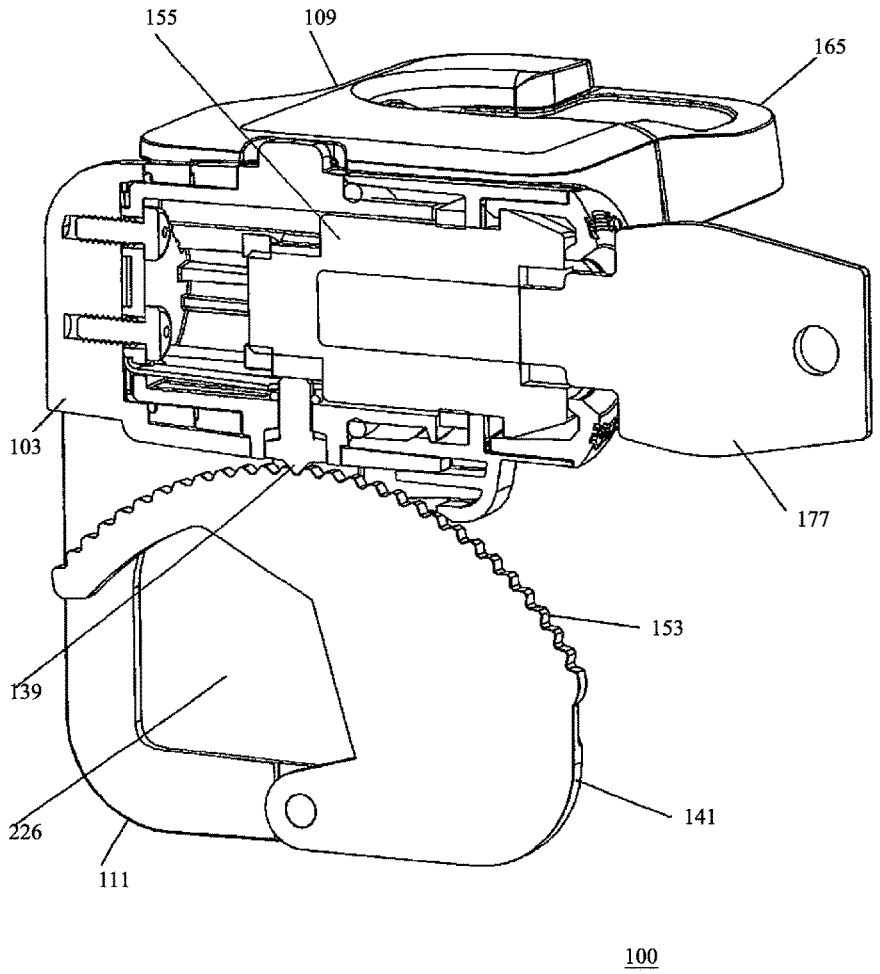
FIG. 24 illustrates a cross-sectional, side elevation view of the interior of the ski locking device.

FIG. 24 illustrates a cross-sectional, side elevation view of the interior of ski locking device 100. FIG. 24 may be compared to FIG. 17, which shows the first ratchet cuff 137 of the lockable closure member locked against the underside of the main housing 103 of the ski locking device. The upper centre of FIG. 24 shows a cross section of the cam lock 155, which was shown as a separate component in FIG. 8. Key 177 is shown in cross section, towards the right of FIG. 24. Third ratchet cuff 165 of the second arm 109 is illustrated in the locked in position at the upper right of FIG. 24.

First ratchet cuff 141 of the lockable closure 2410 member 111 is illustrated below the underside of the main housing 103 of the ski locking device. First ratchet cuff 141 is locked against the underside of the main housing 103. Indentations 153 on the convex outer edge of first ratchet cuff 141 have been engaged by tooth 130. Tooth/peg 130 protrudes from the lower surface of main housing 103 of ski locking device 100.

When the cam lock 155 is unlocked, tooth 130 can rise into main housing 103. This allows the indentations 153 on the convex surface of first ratchet cuff 141 to pass in either direction. This allows the first ratchet cuff 141 to open or close. Whilst first ratchet cuff 141 is free to move, a user of the ski locking device may, by moving first ratchet cuff 141, set the size of the space 226 enclosed by the fixed portion of lockable closure member 111 and the inner concave edge of first ratchet cuff 141.

When the user is satisfied with the size of the space 226, the ski locking device can be locked by rotation of key 177. In the locked configuration, tooth 130 is locked into position, engaging one of the indentations 153. The indentations 153 on the convex surface of first ratchet cuff 141 can no longer pass in either direction. This first ratchet cuff 141 can, as a consequence, no longer move.

Thus, when the key 177 is in the open (unlocked) position, the cam is moved to a position which allows tooth 130 to depress as the first ratchet cuff 141 cuff is rotated across the top of tooth 130. The unlocked position of the key 177 also allows the two teeth that are engaged with the second and third ratchet cuffs to move, so that the second and third ratchet cuffs can move over them. However, when the key is locked, the cam prevents movement of the teeth, and therefore locks all the ratchet cuffs.

Although not shown in FIGS. 11-24, the ski locking device may provide one or more of several additional operational features of value to a user. These may include:

(i) The ski locking device may further comprise an alarm function, operable to provide an alarm indication when the tether has been cut. The alarm function may be implemented as an app on a processor means within the ski locking device, the alarm function operable to generate and send a text message as the alarm indication that the tether has been cut.

(ii) The ski locking device may further comprise a fingerprint recognition subsystem, the fingerprint recognition subsystem being operable to unlock the ski locking device.

(iii) The ski locking device may further comprise a light finder subsystem, the light finder subsystem illuminating a portion of the ski locking device in response to a signal from a user of the ski locking device. A light finder subsystem may be integrated into the tether, the light finder subsystem illuminating a portion of the tether in response to a signal from a user of the ski locking device. The signal may be one of a transmitted signal from a key fob device comprising a battery, the key fob device being activated by a user, or a voice signal from the user.

(iv) The ski locking device may further comprise a solar cell forming part of the ski locking device, the solar cell operable to provide energy to the ski locking device. The solar cell may form part of the tether.

(v) The ski locking device may further comprise a temperature measurement function, whereby in operation a temperature indication may be provided to a user of the ski locking device. A temperature indication may be provided as operation of, or a change to a colour of, an illumination function of the ski locking device.

(vi) The ski locking device may further comprise a GPS locator app, whereby in operation the GPS locator app transmits an indication of the location of the ski locking device, remotely, to a user. Another use of the GPS would be to enable download of telemetry information such as distance covered, speed, change in elevation. This information would be available for uploading to a website for sharing with other skiers, or to provide evidence of whereabouts, speeds etc. The GPS location may also be used to track the skier position. This would offer a function as an avalanche emergency beacon, to aid finding of the user of the ski locking device.

The features and steps of the above embodiments are illustrative only, and variations are possible. The invention is defined in the appended claims.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A ski locking device for securing a first snow ski and a second snow ski, each ski being equipped with a snow brake, the ski locking device comprising:

a housing having a front portion and a rear portion;

at least one lockable closure member having a cuff and extending from the housing so that the rear portion of the housing faces a first edge of a first ski and a second edge of the second ski and where the lockable closure member comprises:

(i) a first ratchet cuff with indentations, the first ratchet cuff being configured to be pivotable about a pivot point;

(ii) a first ratchet mechanism;

wherein the first ratchet mechanism comprises a first tooth located at a lower part of the housing;

when the lockable closure member is in the closed position, the first ratchet mechanism is configured to engage with an indentation on the first ratchet cuff, to lock the lockable closure member; and when the ski locking device is locked, the first tooth is operable to lock into position in contact with one of the indentations on the first ratchet cuff, thereby preventing further movement of the first ratchet cuff; and wherein the housing and the lockable closure member are configured such that, when the ski locking device is in a closed position with a slide surface of the first ski facing a slide surface of the second ski, the lockable closure member encloses the snow brakes at their crossing point for locking the lockable closure member to the first ski and the second ski.

2. The ski locking device of claim 1, further comprising:

when the ski locking device is in the closed position locking the pair of skis, a space enclosed by the lockable closure member is of an adjustable size.

3. The ski locking device of claim 1, further comprising:

a first arm comprising a second ratchet cuff;

a second arm comprising a third ratchet cuff;

the second ratchet cuff further comprising second indentations, the second indentations engaging with a second tooth mounted on a first side of the housing; and the third ratchet cuff further comprising third indentations, the third indentations engaging with a third tooth mounted on a second side of the housing.

4. The ski locking device of claim 3, wherein:

the first arm is moveable, and is configured to rotate from a first storage position to a first deployed position;

the second arm is moveable, and is configured to rotate from a second storage position to a second deployed position;

wherein:

when the first arm is in the first storage position, the first arm lies adjacent to a first side of the lockable closure member;

when the second arm is in the second storage position, the second arm lies adjacent to a second side of the lockable closure member;

when the first arm is in the first deployed position, the second ratchet cuff is operable to lock around a first ski pole; and when the second arm is in the second deployed position, the third ratchet cuff is operable to lock around a second ski pole.

5. The ski locking device of claim 1, further comprising:

the housing and the lockable closure member being configured such that, when the ski locking device is in the closed position locking the pair of skis, with the slide surface of the first ski facing the slide surface of the second ski, the rear portion of the housing abuts the first edge of the first ski and the second edge of the second ski.

6. The ski locking device of claim 5, wherein:

the rear portion of the housing has a central protruding portion; and the central protruding portion is configured to lie between the slide surface of the first ski and the slide surface of the second ski, when the ski locking device is in the closed position.

7. The ski locking device of claim 3, wherein:

a cylinder cam lock within the housing is operable to lock the locking device, by locking into position first, second and third teeth protruding from an outer surface of the housing;

whereby the first tooth locks into position to prevent movement of the first ratchet cuff, the second tooth locks into position to prevent movement of the second ratchet cuff, and the third tooth locks into position to prevent movement of the third ratchet cuff.

8. The ski locking device of claim 3, wherein:

in operation, when the ski locking device is in the closed position locking a pair of skis, oriented with the lockable closure member above the housing:

the second ratchet cuff is closable by movement in a first direction, relative to an upper surface of the ski locking device; and the third ratchet cuff is closable by movement in a second direction, relative to an upper surface of the ski locking device.

9. The ski locking device of claim 3, wherein in operation, when the ski locking device is in the closed position locking a pair of skis, oriented with the lockable closure member below the housing:

the second ratchet cuff is closable by movement in a first direction, relative to an upper surface of the ski locking device; and the third ratchet cuff is closable by movement in a second direction, relative to the upper surface of the ski locking device.

10. The ski locking device of claim 3, wherein:

a first flexible pole bumper element lies in an inner edge of the second ratchet cuff; and a second flexible pole bumper element lies in an inner edge of the third ratchet cuff.

11. The ski locking device of claim 3, further comprising:

a separate tether, the tether comprising a closed loop at either end, whereby in operation the ski locking device can be fastened to another object by passing the tether around the object, and enclosing each loop of the tether in one of the second ratchet cuff and the third ratchet cuff.

12. The ski locking device of claim 11, further comprising:

an alarm function, operable to provide an alarm indication when the tether has been cut; and wherein the alarm function is implemented as an app on a processor means within the ski locking device, the alarm function operable to generate and send a text message as the alarm indication that the tether has been cut.

13. The ski locking device of claim 1, further comprising:

a light finder subsystem, the light finder subsystem illuminating a portion of the ski locking device in response to a signal from a user of the ski locking device.

14. The ski locking device of claim 1, further comprising:

a solar cell forming part of the ski locking device, the solar cell operable to provide energy to the ski locking device.

15. The ski locking device of claim 1, further comprising:

a temperature measurement function, whereby in operation a temperature indication may be provided to a user of the ski locking device;

wherein a temperature indication is provided as operation of, or a change to a colour of, an illumination function of the ski locking device.

16. The ski locking device of claim 1, further comprising:

a GPS locator app, whereby in operation the GPS locator app transmits an indication of the location of the ski locking device, remotely, to a user; and/or a fingerprint recognition subsystem, the fingerprint recognition subsystem being operable to unlock the ski locking device.

17. A method of locking a pair of snow skis, each snow ski being equipped with a snow brake, the method comprising:

placing a ski locking device having a front portion and rear portion of a housing with the rear portion of the housing in a position where the rear portion of the housing faces a first edge of the first ski and a second edge of the second ski;

opening a lockable closure member such that its opening substantially faces the front portion of the housing, the lockable closure member comprising a rigid member, the rigid member pivoted at a point where the rigid member joins the housing;

placing the lockable closure member around the snow brakes at a crossing point of the snow brakes, the lockable closure member being connected to the housing; and closing and locking the lockable closure member, whereby the lockable closure member encloses the crossing point of the snow brakes.

18. A ski locking device, as in claim 1 wherein the locking device is configured to lock a bicycle.

* * * * *